US010825465B2

(12) United States Patent
Sugiyama et al.

(10) Patent No.: US 10,825,465 B2
(45) Date of Patent: Nov. 3, 2020

(54) SIGNAL PROCESSING APPARATUS, GAIN ADJUSTMENT METHOD, AND GAIN ADJUSTMENT PROGRAM

(71) Applicants: NEC CORPORATION, Tokyo (JP); NEC Platforms, Ltd., Kanagawa (JP)

(72) Inventors: Akihiko Sugiyama, Tokyo (JP); Ryoji Miyahara, Kanagawa (JP)

(73) Assignees: NEC CORPORATION, Tokyo (JP); NEC Platforms, Ltd., Kawasaki (JP)

( * ) Notice: Subject to any disclaimer, the term of this patent is extended or adjusted under 35 U.S.C. 154(b) by 119 days.

(21) Appl. No.: 16/067,850

(22) PCT Filed: Dec. 20, 2016

(86) PCT No.: PCT/JP2016/087968
§ 371 (c)(1),
(2) Date: Jul. 3, 2018

(87) PCT Pub. No.: WO2017/119284
PCT Pub. Date: Jul. 13, 2017

(65) Prior Publication Data

US 2019/0027159 A1 Jan. 24, 2019

(30) Foreign Application Priority Data

Jan. 8, 2016 (JP) ..... 2016-003076

(51) Int. Cl.
*G10L 21/028* (2013.01)
*H04R 3/00* (2006.01)
(Continued)

(52) U.S. Cl.
CPC ..... *G10L 21/028* (2013.01); *G10L 21/0208* (2013.01); *G10L 25/84* (2013.01);
(Continued)

(58) Field of Classification Search
CPC .... G10L 21/028; G10L 15/20; G10L 21/0208
(Continued)

(56) References Cited

U.S. PATENT DOCUMENTS 5,727,073 A 3/1998 Ikeda
5,822,728 A * 10/1998 Applebaum ..... G10L 15/08 704/254
(Continued)

FOREIGN PATENT DOCUMENTS

JP 8-033091 A 2/1996
JP 9-018291 A 1/1997
(Continued)

OTHER PUBLICATIONS

Steven F. Boll, "Suppression of Acoustic Noise in Speech Using Spectral Subtraction", IEEE Transactions on Acoustics, Speech, and Signal Processing, vol. ASSP-27, No. 2, Apr. 1979, pp. 113-120 (8 pages total).
(Continued)

*Primary Examiner* — Jakieda R Jackson
(74) *Attorney, Agent, or Firm* — Sughrue Mion, PLLC

(57) ABSTRACT

There is provided a signal processing apparatus for amplifying or attenuating, with respect to a signal in which a desired signal and another signal are mixed, the desired signal and the other signal at different ratios. The signal processing apparatus includes a separator that obtains an estimated first signal and an estimated second signal by receiving a mixed signal in which a first signal (for example, speech) and a second signal (for example, noise) are mixed and estimating the first signal and the second signal. Furthermore, the signal processing apparatus includes a gain adjuster that obtains a gain-adjusted mixed signal by receiving the estimated first signal and the estimated second signal.

22 Claims, 25 Drawing Sheets

(51) Int. Cl.
*G10L 21/0208* (2013.01)
*G10L 25/84* (2013.01)
*G10L 21/0316* (2013.01)
*G10L 21/0272* (2013.01)

(52) U.S. Cl.
CPC ..... *H04R 3/00* (2013.01); *G10L 21/0272* (2013.01); *G10L 21/0316* (2013.01); *H04R 2420/01* (2013.01); *H04R 2430/01* (2013.01)

(58) Field of Classification Search
USPC ..... 704/233
See application file for complete search history.

(56) References Cited

U.S. PATENT DOCUMENTS 5,930,336 A * 7/1999 Junqua ..... G10L 15/02 379/88.03
7,184,937 B1 * 2/2007 Su ..... G01R 23/02 324/536
7,590,528 B2 9/2009 Kato et al.
7,720,233 B2 5/2010 Sato et al.
8,050,717 B2 11/2011 Sugiyama
8,223,989 B2 7/2012 Sugiyama
8,736,359 B2 5/2014 Sugiyama
9,318,119 B2 4/2016 Sugiyama et al.
9,543,926 B2 1/2017 Sato et al.
9,905,247 B2 2/2018 Sugiyama et al.
2004/0049383 A1 3/2004 Kato et al.
2007/0021958 A1 * 1/2007 Visser ..... G10L 21/0272 704/226
2007/0053455 A1 3/2007 Sugiyama
2007/0071253 A1 3/2007 Sato et al.
2008/0201138 A1 * 8/2008 Visser ..... G10L 21/0208 704/227
2008/0262835 A1 * 10/2008 Oshikiri ..... G10L 21/038 704/205
2009/0299742 A1 * 12/2009 Toman ..... G10L 21/0208 704/233
2010/0010808 A1 1/2010 Sugiyama et al.
2010/0217587 A1 8/2010 Sato et al.
2011/0286604 A1 11/2011 Matsuo
2012/0033725 A1 2/2012 Sugiyama
2012/0158404 A1 * 6/2012 Shin ..... G10L 21/0216 704/233
2012/0268198 A1 10/2012 Sugiyama
2015/0269947 A1 * 9/2015 Liu ..... G10L 19/028 704/500
2016/0254008 A1 9/2016 Sugiyama et al.
2016/0261951 A1 * 9/2016 Matheja ..... G10L 21/0232
2016/0329949 A1 * 11/2016 Cloutier ..... H04B 7/0885

FOREIGN PATENT DOCUMENTS

JP 2001-095082 A 4/2001
JP 2002-204175 A 7/2002
JP 2007-068125 A 3/2007
JP 2009-193031 A 8/2009
JP 2011-100030 A 5/2011
JP 2011-244232 A 12/2011
JP 2012-120133 A 6/2012
JP 2013-168878 A 8/2013
JP 2014-160156 A 9/2014
JP 9-311696 A 12/2017
WO 2005/024787 A1 3/2005
WO 2007/026691 A1 3/2007
WO 2015/049921 A1 4/2015

OTHER PUBLICATIONS

Yariv Ephraim et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121 (13 pages total).
Jalal Taghia et al., "An Evaluation of Noise Power Spectral Density Estimation Algorithms in Adverse Acoustic Environments", IEEE Proceedings of International Conference on Acoustics, Speech, and Signal Processing, pp. 4640-4643, May 2011 (4 pages total).
Lloyd J. Griffiths et al., "An Alternative Approach to Linearly Constrained Adaptive Beamforming", IEEE Transactions on Antennas and Propagation, vol. AP-30, No. 1, Jan. 1982, pp. 27-34 (8 pages total).
S. Gannot et al., "Adaptive Beamforming and Postfiltering", Handbook of Speech Processing, Springer, Berlin Heidelberg New York, 2008, pp. 945-978 (34 pages total).
Akihiko Sugiyama et al., "A Directional Noise Suppressor With a Specified Beamwidth", IEEE Proceedings of International Conference on Acoustics, Speech, and Signal Processing, pp. 524-528, Apr. 2015 (5 pages total).
Bernard Widrow et al., "Adaptive Noise Cancelling: Principles and Applications", Proceedings of the IEEE, Vol. 63, No. 12, pp. 1692-1716, Dec. 1975 (25 pages total).
International Search Report dated Mar. 7, 2017 issued by the International Searching Authority in International Application No. PCT/JP2016/087968.

* cited by examiner

SIGNAL PROCESSING APPARATUS, GAIN ADJUSTMENT METHOD, AND GAIN ADJUSTMENT PROGRAM

CROSS REFERENCE TO RELATED APPLICATIONS

This application is a National Stage of International Application No. PCT/JP2016/087968 filed Dec. 20, 2016, claiming priority based on Japanese patent application No. 2016-003076, filed on Jan. 8, 2016, the disclosure of which is incorporated herein in its entirety by reference.

TECHNICAL FIELD

The present invention relates to a technique of amplifying or attenuating a signal.

BACKGROUND ART

In the above technical field, patent literature 1 describes an automatic gain adjustment apparatus capable of listening to only target speech without distortion with an appropriate volume regardless of a variation in voice volume of a speaker and a variation in a distance to a microphone.

This technique suppresses background noise included in an input signal, and determines a threshold as a compression/decompression boundary based on effective values of residual noise of frames determined as noise frames, thereby smoothing the effective values of past frames. A compression ratio is calculated from the smoothed effective value, and a necessary gain is obtained from the threshold and a target average effective value. The obtained gain is applied to the input signal after the background noise is suppressed, thereby automatically adjusting the gain.

CITATION LIST

Patent Literature

Patent literature 1: Japanese Patent Laid-Open No. 9-311696

Patent literature 2: Japanese Patent Laid-Open No. 2002-204175

Patent literature 3: International Publication No. 2007/026691

Patent literature 4: Japanese Patent Laid-Open No. 2007-68125

Patent literature 5: International Publication No. 2015/049921

Patent literature 6: Japanese Patent Laid-Open No. 9-18291

Patent literature 7: International Publication No. 2005/024787

Patent literature 8: Japanese Patent Laid-Open No. 2011-100030

Non-Patent Literature

Non-patent literature 1: IEEE TRANSACTION ON ACOUSTIC, SPEECH, AND SIGNAL PROCESSING, VOL. 27, No. 2, PP. 113-120, Apr. 1979

Non-patent literature 2: IEEE TRANSACTION ON ACOUSTIC, SPEECH, AND SIGNAL PROCESSING, VOL. 32, No. 6, PP. 1109-1121, Dec. 1984

Non-patent literature 3: IEEE PROCEEDINGS OF INTERNATIONAL CONFERENCE ON ACOUSTICS, SPEECH, AND SIGNAL PROCESSING, PP. 4640-4643, May 2011

Non-patent literature 4: IEEE TRANSACTION ON ACOUSTIC, SPEECH, AND SIGNAL PROCESSING, VOL. 30, No. 1, PP. 27-34, Jan. 1982

Non-patent literature 5: HANDBOOK OF SPEECH PROCESSING, SPRINGER, BERLIN HEIDELBERG NEW YORK, 2008

Non-patent literature 6: IEEE PROCEEDINGS OF INTERNATIONAL CONFERENCE ON ACOUSTICS, SPEECH, AND SIGNAL PROCESSING, PP. 524-528, Apr. 2015

Non-patent literature 7: PROCEEDINGS OF IEEE, VOL. 63, No. 12, PP. 1692-1716, Dec. 1975

SUMMARY OF THE INVENTION

Technical Problem

In this technique, however, since an output signal is obtained by applying a gain to a signal after background noise is suppressed, noise (components other than speech) included in the input signal is suppressed and only the speech is output. Therefore, this technique cannot cope with a case in which an environmental sound needs to be held in recording a natural sound or a case in which an environmental sound needs to be slightly suppressed.

That is, with respect to a signal in which a desired signal and another signal are mixed, it is impossible to amplify or attenuate the desired signal and the other signal at different ratios.

The present invention enables to provide a technique of solving the above-described problem.

Solution to Problem

One example aspect of the present invention provides a signal processing apparatus comprising:

a unit that obtains an estimated first signal and an estimated second signal by inputting a mixed signal in which a first signal and a second signal are mixed; and a unit that obtains a gain-adjusted mixed signal based on the estimated first signal and the estimated second signal.

Another example aspect of the present invention provides a gain adjustment method comprising:

obtaining an estimated first signal and an estimated second signal by inputting a mixed signal in which a first signal and a second signal are mixed; and obtaining a gain-adjusted mixed signal based on the estimated first signal and the estimated second signal.

Still other example aspect of the present invention provides a gain adjustment program for causing a computer to execute a method, comprising:

obtaining an estimated first signal and an estimated second signal by inputting a mixed signal in which a first signal and a second signal are mixed; and obtaining a gain-adjusted mixed signal based on the estimated first signal and the estimated second signal.

Advantageous Effects of Invention

According to the present invention, with respect to a signal in which a desired signal and another signal are mixed, it is possible to amplify or attenuate the desired signal and the other signal at different ratios.

DESCRIPTION OF EXAMPLE EMBODIMENTS

Example embodiments of the present invention will now be described in detail with reference to the drawings. It should be noted that the relative arrangement of the components, the numerical expressions and numerical values set forth in these example embodiments do not limit the scope of the present invention unless it is specifically stated otherwise. Note that "speech signal" in the following explanation indicates a direct electrical change that occurs in accordance with speech or another sound. The speech signal transmits speech or another sound and is not limited to speech. Some example embodiments in which the number of input mixed signals is four will be described. However, these are merely examples, and the same applies to an arbitrary number of two or more signals.

First Example Embodiment

Figure 1:
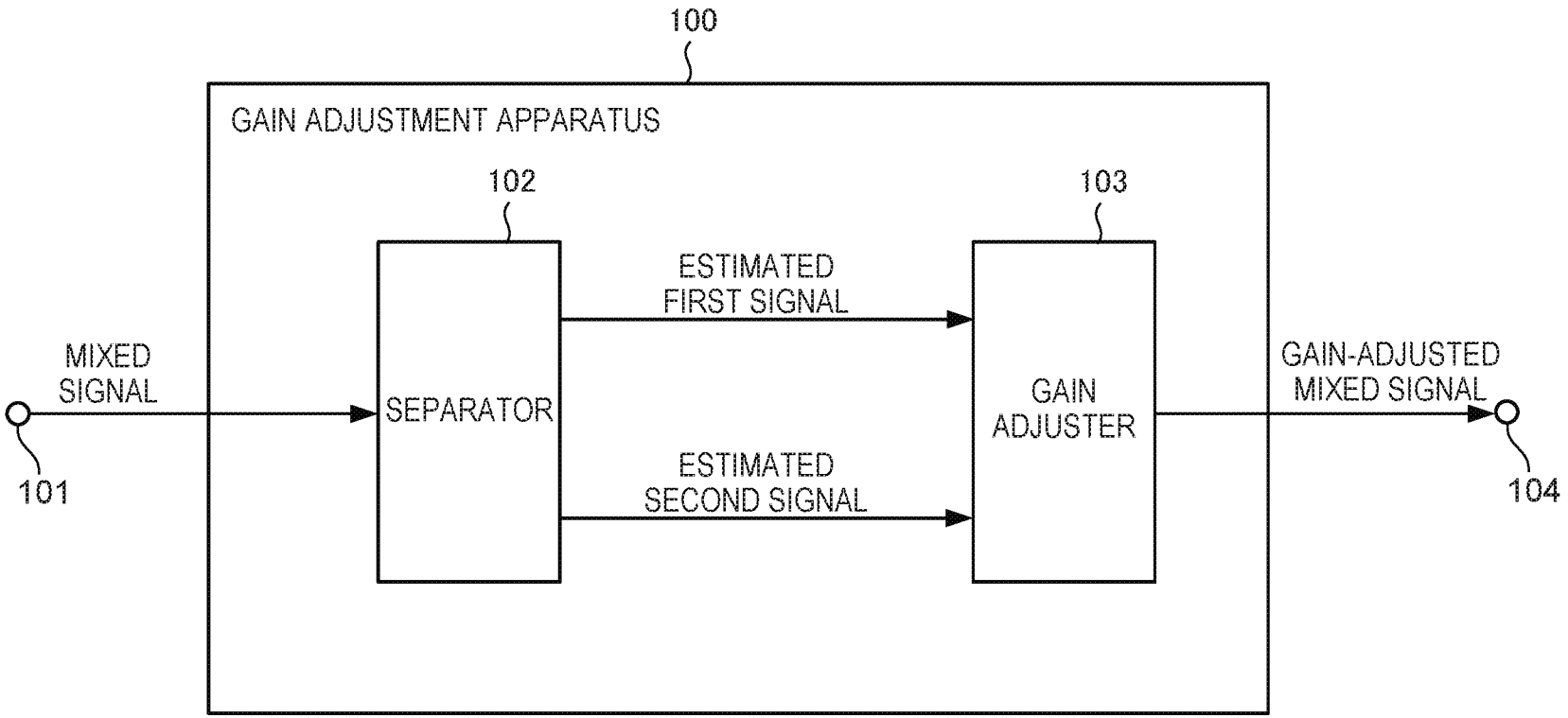
FIG. 1 is a block diagram showing the arrangement of a gain adjustment apparatus according to the first example embodiment of the present invention.

A gain adjustment apparatus 100 according to the first example embodiment of the present invention will be described with reference to FIG. 1. The gain adjustment apparatus 100 is an apparatus that inputs, from an external terminal or a sensor such as a microphone 101, a mixed signal in which the first signal (for example, speech) and the second signal (for example, noise) are mixed, and amplifies/attenuates the first and second signals at different ratios. As shown in FIG. 1, the gain adjustment apparatus 100 includes a separator 102 and a gain adjuster 103. The separator 102 obtains, from the mixed signal, an estimated first signal as an estimated value of the first signal and an estimated second signal as an estimated value of the second signal. The gain adjuster 103 performs processing to apply different gains to the estimated first and second signals input from the separator 102, thereby obtaining a gain-adjusted mixed signal.

With this arrangement, the gain adjustment apparatus 100 can adjust the gains of the first and second signals included in the mixed signal. Therefore, with respect to a signal in which a desired signal and another signal are mixed, it is possible to amplify or attenuate the desired signal and the other signal at different ratios.

Second Example Embodiment

A gain adjustment apparatus according to the second example embodiment of the present invention will be described with reference to FIG. 2. The gain adjustment apparatus according to this example embodiment has an arrangement obtained by replacing the gain adjuster 103 included in the gain adjustment apparatus 100 shown in FIG. 1 with a gain adjuster 203 shown in FIG. 2.

Figure 2:
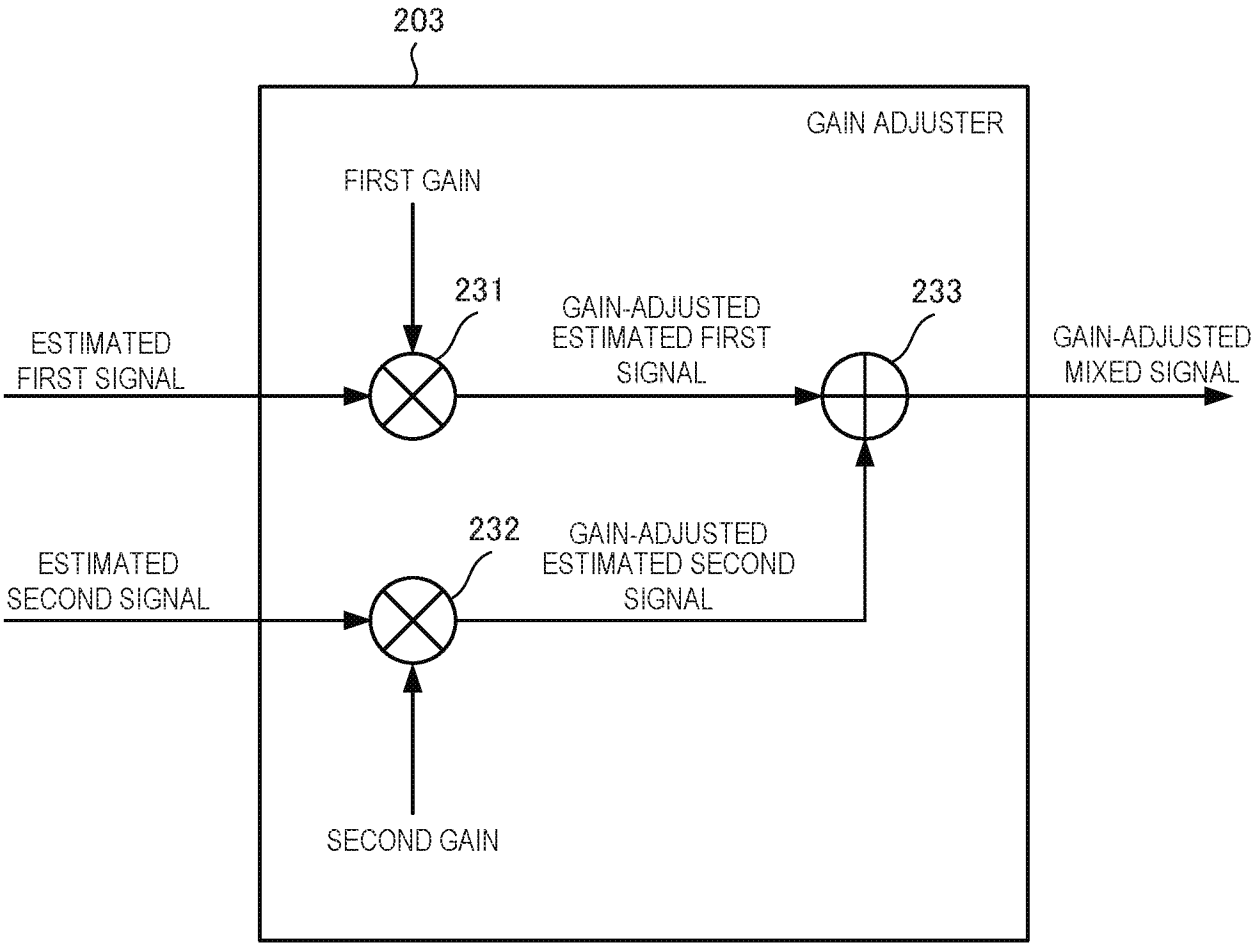
FIG. 2 is a block diagram showing the arrangement of a gain adjuster according to the second example embodiment of the present invention.

As shown in FIG. 2, the gain adjuster 203 includes multipliers 231 and 232 and an adder 233. The multiplier 231 obtains a gain-adjusted estimated first signal by multiplying an estimated first signal by the first gain, and supplies it to the adder 233. The multiplier 232 obtains a gain-adjusted estimated second signal by multiplying an estimated second signal by the second gain, and supplies it to the adder 233. The adder 233 obtains a gain-adjusted mixed signal by adding the gain-adjusted estimated first signal and the gain-adjusted estimated second signal, and outputs it. The first and second gains may be externally supplied or may be stored in advance in a memory.

With this arrangement, the gain adjustment apparatus can generate a gain-adjusted mixed signal by applying different gains to the first and second signals included in a mixed signal and then adding the signals, in addition to the effect of the first example embodiment.

Third Example Embodiment

A gain adjustment apparatus according to the third example embodiment of the present invention will be described with reference to FIG. 3. The gain adjustment apparatus according to this example embodiment has an arrangement obtained by replacing the gain adjuster 103 shown in FIG. 1 with a gain adjuster 303 shown in FIG. 3.

Figure 3:
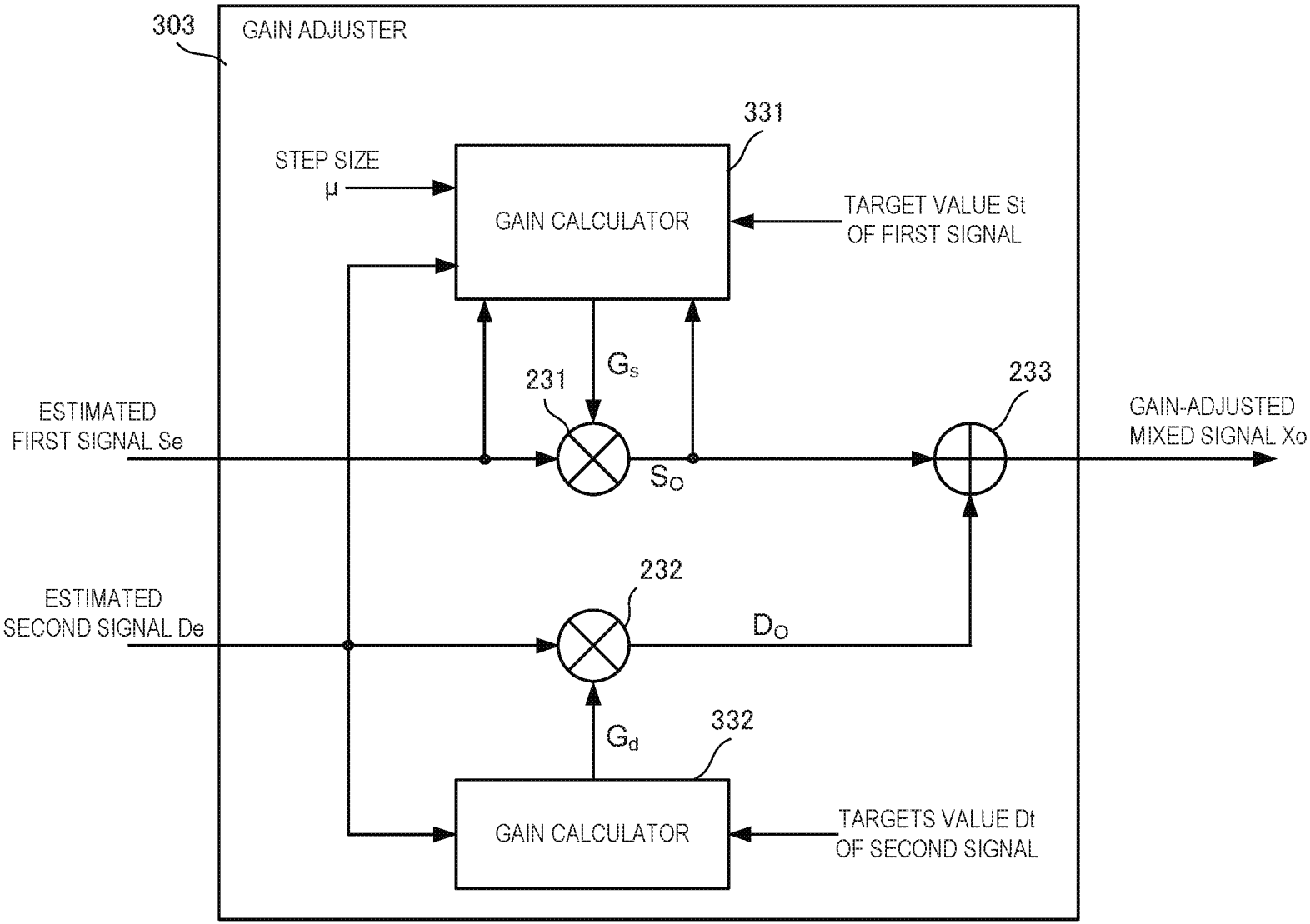
FIG. 3 is a block diagram showing the arrangement of a gain adjuster according to the third example embodiment of the present invention.

As shown in FIG. 3, the gain adjuster 303 includes a gain calculator 331 and a gain calculator 332 in addition to the multipliers 231 and 232 and the adder 233 of the second example embodiment. The multiplier 231 obtains a gain-adjusted estimated first signal So by multiplying an estimated first signal Se by a first gain Gs, and supplies it to the adder 233. The multiplier 232 obtains a gain-adjusted estimated second signal Do by multiplying an estimated second signal De by a second gain Gd, and supplies it to the adder 233. The adder 233 obtains a gain-adjusted mixed signal by adding the gain-adjusted estimated first signal So and the gain-adjusted estimated second signal Do, and outputs it.

The gain calculator 332 determines the second gain Gd so that the gain-adjusted estimated second signal Do becomes equal to a target value Dt of the second signal. That is, $Gd=|Dt|/|De|$.

The gain calculator 331 determines the first gain Gs so that the gain-adjusted estimated first signal So becomes equal to a target value St. However, for example, the non-stationarity of the first signal such as speech is generally higher than that of the second signal such as noise, and the non-stationarity of the value of the gain is also high. Therefore, the first gain Gs is preferably obtained by serial processing by appropriate control. The gain calculator 331 sequentially calculates the first gain Gs using the estimated first signal Se, the gain-adjusted estimated first signal So, the target value St of the first signal, and a step size $\mu$. At this time, the maximum or minimum value of the upper limit value of the first gain Gs may be limited using the estimated second signal De. By limiting the upper limit value of the first gain Gs, it is possible to prevent unnatural signal attenuation and distortion caused by excessive amplification when the first signal is small.

Note that the second gain is obtained using the absolute values of the estimated second signal De and the target value Dt of the gain-adjusted estimated second signal Do. However, the gain may be obtained using powers. Similarly, the gain calculator 331 may calculate the first gain using the absolute values of the estimated first signal Se, the gain-adjusted estimated first signal So, and the target value St of the first signal or using powers. Furthermore, the second gain Gd may be obtained by the same method as that for the first gain Gs using the gain calculator 331 instead of the gain calculator 332. Conversely, the first gain Gs may be obtained by the same method as that for the second gain Gd using the gain calculator 332 instead of the gain calculator 331.

With this arrangement, it is possible to determine different gains in accordance with the target values of the first and second signals, in addition to the effect of the first example embodiment.

Fourth Example Embodiment

A gain adjustment apparatus according to the fourth example embodiment of the present invention will be described with reference to FIG. 4. The gain adjustment apparatus according to this example embodiment has an arrangement obtained by replacing the gain adjuster 103 shown in FIG. 1 with a gain adjuster 403 shown in FIG. 4.

Figure 4:
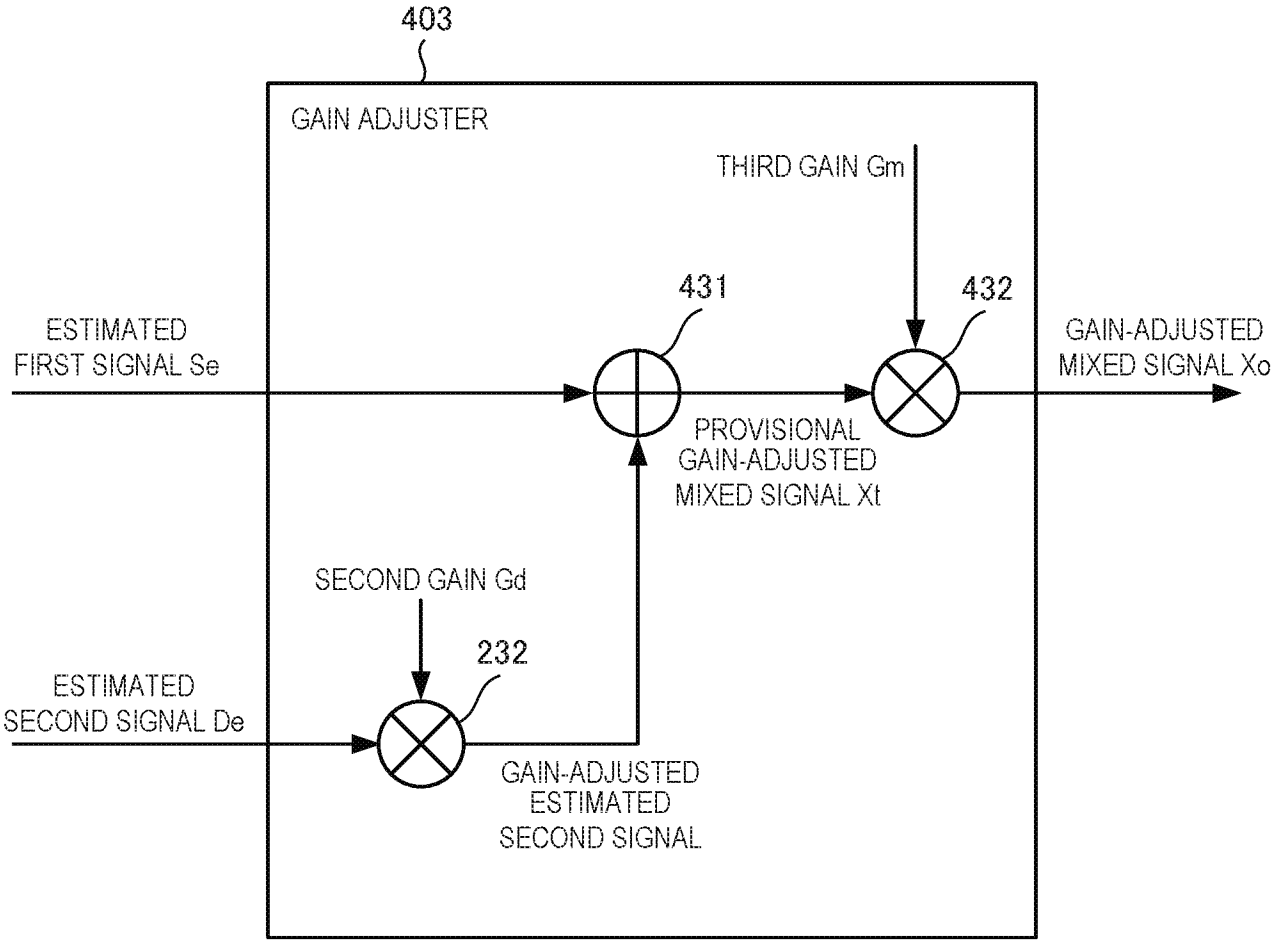
FIG. 4 is a block diagram showing the arrangement of a gain adjuster according to the fourth example embodiment of the present invention.

As shown in FIG. 4, the gain adjuster 403 includes a multiplier 232, an adder 431, and a multiplier 432. The multiplier 232 obtains a gain-adjusted estimated second signal by multiplying an estimated second signal by a second gain Gd, and supplies it to the adder 431. The adder 431 obtains a provisional gain-adjusted mixed signal by adding an estimated first signal and the gain-adjusted estimated second signal, and supplies it to the multiplier 432. The multiplier 432 obtains a gain-adjusted mixed signal by multiplying the provisional gain-adjusted mixed signal by a third gain Gm, and outputs it. The second and third gains may be externally supplied or may be stored in advance in a memory.

The second example embodiment shown in FIG. 2 is different from this example embodiment shown in FIG. 4 in the following point. The second example embodiment adopts the arrangement of individually controlling the levels of the estimated first and second signals, and then adding the signals. On the other hand, in the fourth example embodiment, the level of an estimated second signal De is controlled and the estimated second signal De is added to an estimated first signal Se, thereby obtaining a provisional gain-adjusted mixed signal. That is, a provisional gain-adjusted mixed signal Xp is given by $Xp=Gd\cdot De+Se$. After that, by applying the third gain Gm to the provisional gain-adjusted mixed signal Xp, a gain-adjusted mixed signal Xo is obtained by $Xo=Gm\cdot Gd\cdot De+Gm\cdot Se$. That is, an equivalent gain for the estimated first signal is Gm and an equivalent gain for the estimated second signal is $Gm\cdot Gd$. Therefore, by appropriately determining the third gain Gm for the estimated first signal Se, and appropriately determining, as the second gain Gd, $Gm\cdot Gd$ for the estimated second signal De, it is possible to amplify or attenuate a desired signal and another signal at different ratios.

With this arrangement, the gain adjustment apparatus can generate a gain-adjusted mixed signal by applying a gain to the second signal included in a mixed signal to set a ratio with respect to the first signal, and applying another gain to a result of adding the obtained second signal and the estimated value of the first signal.

Fifth Example Embodiment

A gain adjustment apparatus according to the fifth example embodiment of the preset invention will be described with reference to FIG. 5. The gain adjustment apparatus according to this example embodiment has an arrangement obtained by replacing the gain adjuster 103 shown in FIG. 1 with a gain adjuster 503 shown in FIG. 5.

Figure 5:
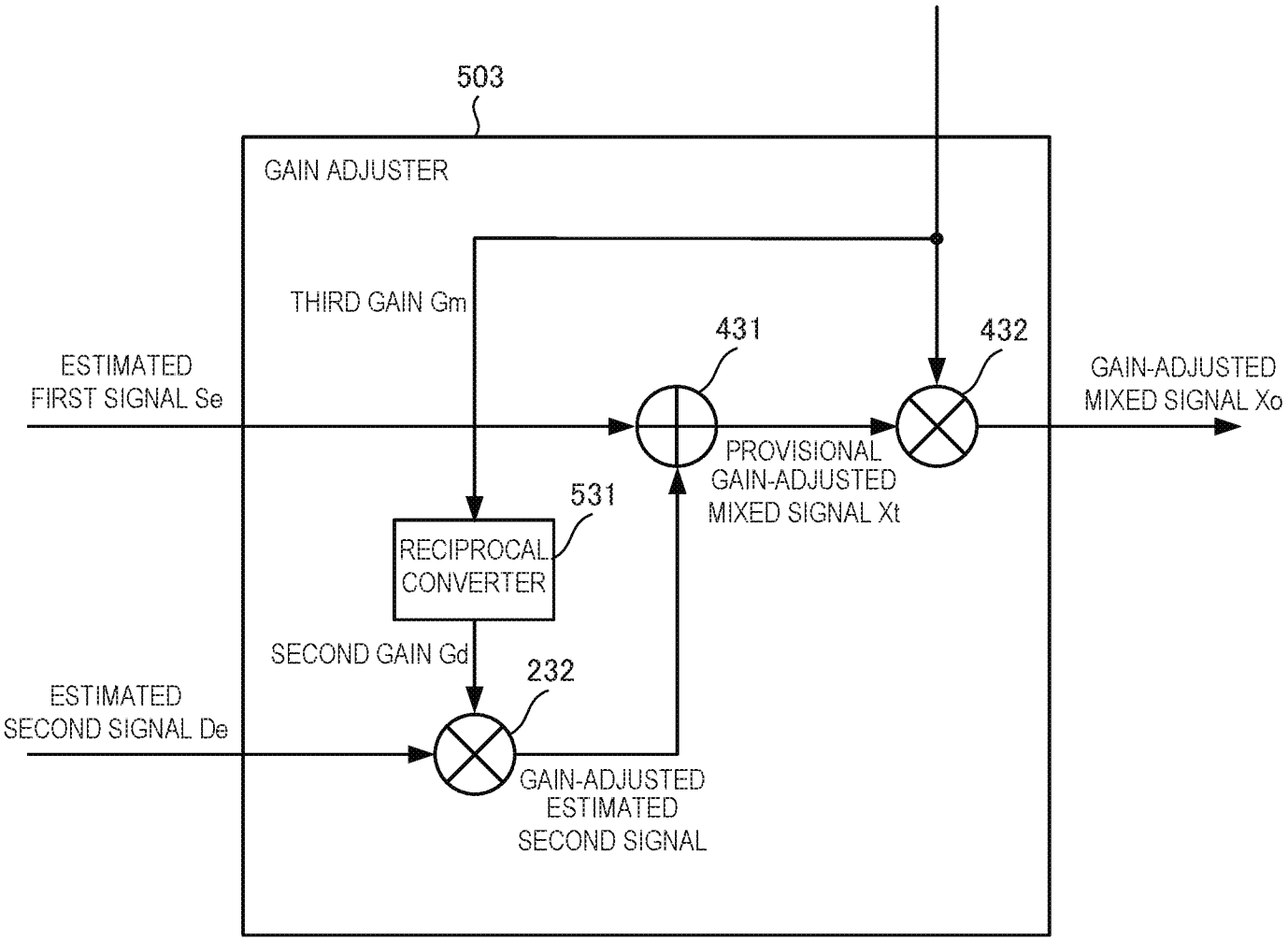
FIG. 5 is a block diagram showing the arrangement of a gain adjuster according to the fifth example embodiment of the present invention.

As shown in FIG. 5, the gain adjuster 503 includes a multiplier 232, an adder 431, a multiplier 432, and a reciprocal converter 531. This example embodiment shown in FIG. 5 is obtained by adding the reciprocal converter 531 to the fourth example embodiment shown in FIG. 4. The reciprocal converter 531 obtains a reciprocal 1/Gm of a third gain Gm and supplies it as a second gain Gd to the multiplier 232. That is, $Gd=1/Gm$. At this time, a gain-adjusted mixed signal Xo is given by $Xo=De+Gm\cdot Se$.

In the fourth example embodiment, an equivalent gain for an estimated first signal is Gm and an equivalent gain for an estimated second signal is Gm·Gd. In this example embodiment, however, an equivalent gain for an estimated first signal is Gm and an equivalent gain for an estimated second signal is 1. Therefore, by appropriately controlling only the third gain Gm, it is possible to amplify or attenuate a desired signal at an arbitrary ratio and set another signal level invariable.

With this arrangement, the gain adjustment apparatus can appropriately amplify or attenuate the first signal without changing the level of the second signal by setting an appropriate gain for the first signal included in a mixed signal. In addition, since only one gain is controlled, this example embodiment can be implemented by simple processing. Therefore, by only controlling a single gain for a signal in which a desired signal and another signal are mixed, it is possible to amplify or attenuate the desired signal at an arbitrary ratio and set the level of the other signal invariable.

Sixth Example Embodiment

A gain adjustment apparatus according to the sixth example embodiment of the present invention will be described with reference to FIG. 6. The gain adjustment apparatus according to this example embodiment has an arrangement obtained by replacing the gain adjuster 103 shown in FIG. 1 with a gain adjuster 603 shown in FIG. 6.

Figure 6:
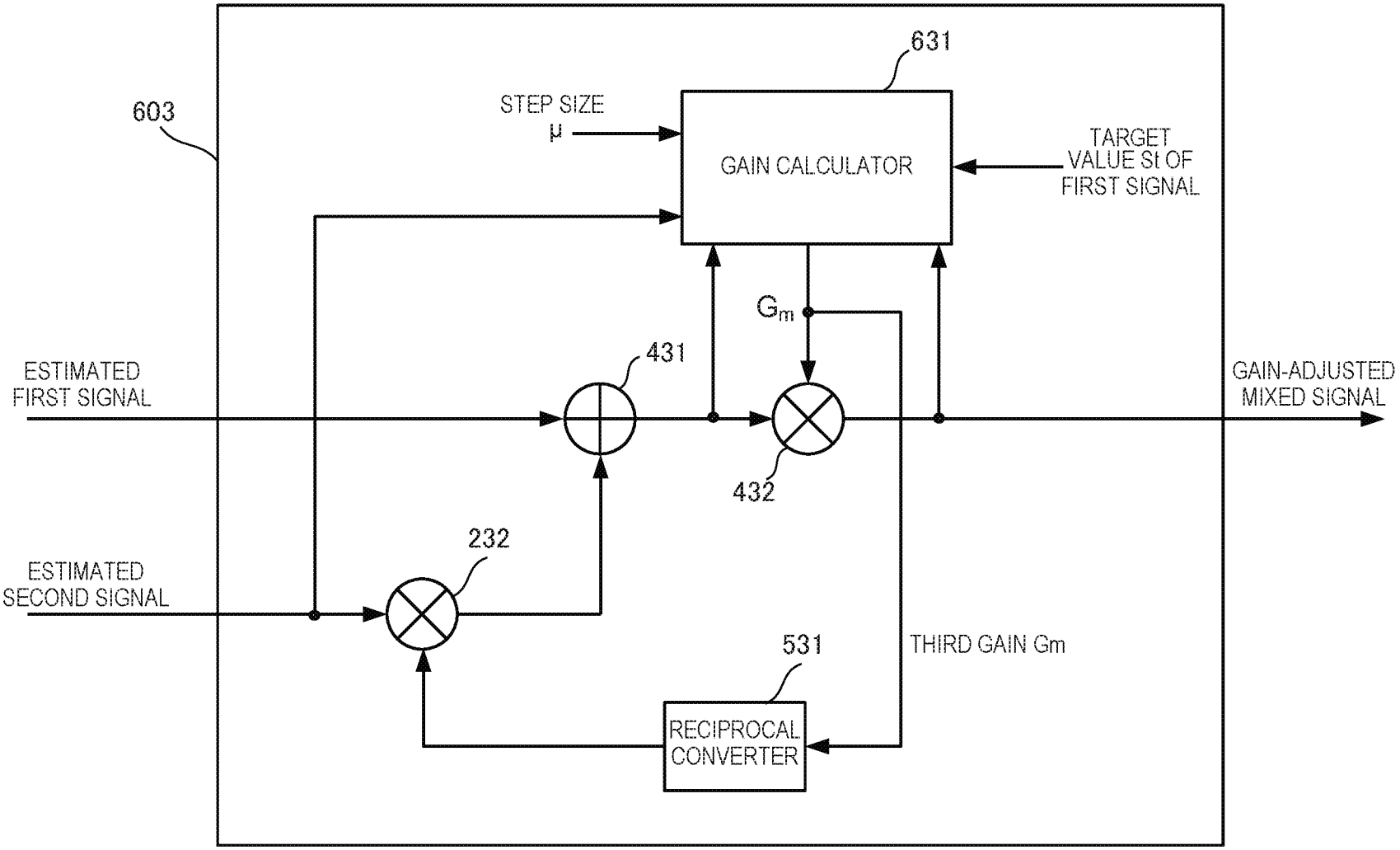
FIG. 6 is a block diagram showing the arrangement of a gain adjuster according to the sixth example embodiment of the present invention.

As shown in FIG. 6, the gain adjuster 603 includes a multiplier 232, an adder 431, a multiplier 432, a reciprocal converter 531, and a gain calculator 631. The sixth example embodiment shown in FIG. 6 is different from the fifth example embodiment shown in FIG. 5 in terms of the gain calculator 631. That is, a third gain Gm is calculated by the gain calculator 631 from a provisional gain-adjusted mixed signal Xp, a gain-adjusted mixed signal Xo, and a target value St of the first signal, instead of being externally supplied or being stored in a memory. The gain calculator 631 has exactly the same arrangement as that of the gain calculator 331 according to the third example embodiment, and performs the same operation. As described concerning the gain calculator 331, the gain calculator 631 may limit the maximum and minimum values of the upper limit value of the third gain Gm using an estimated second signal De. By limiting the upper limit value of the third gain Gm, it is possible to prevent unnatural signal attenuation and distortion caused by excessive amplification when the first signal is small.

With this arrangement, by setting a target value for the first signal included in a mixed signal, the gain adjustment apparatus can amplify or attenuate the first signal to match the target value without changing the level of the second signal. In addition, since only one gain is controlled, this example embodiment can be implemented by simple processing. Therefore, by only controlling a single gain for a signal in which a desired signal and another signal are mixed, it is possible to amplify or attenuate the desired signal at an arbitrary ratio according to the target value and set the level of the other signal invariable.

Seventh Example Embodiment

A gain adjustment apparatus according to the seventh example embodiment of the present invention will be described with reference to FIG. 7. The gain adjustment apparatus according to this example embodiment has an arrangement obtained by replacing the separator 102 shown in FIG. 1 with a separator 702 shown in FIG. 7.

Figure 7:
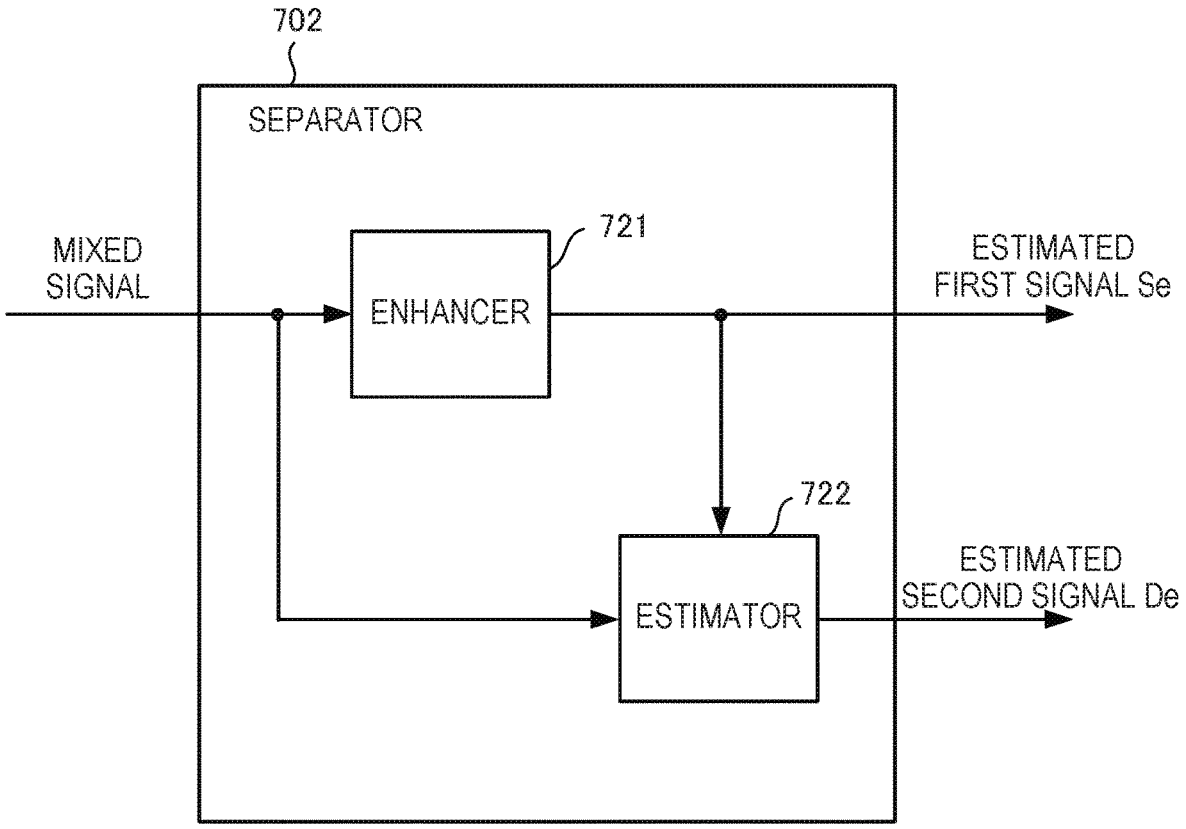
FIG. 7 is a block diagram showing the arrangement of a separator according to the seventh example embodiment of the present invention.

As shown in FIG. 7, the separator 702 includes an enhancer 721 and an estimator 722. The enhancer 721 receives a mixed signal, enhances the first signal, and outputs the enhanced first signal as an estimated first signal that is an estimated value of the first signal. The enhancer 721 generally has an arrangement called a noise suppressor. Details of the noise suppressor are disclosed in patent literatures 2 and 3, non-patent literatures 1 and 2, and the like.

Based on the mixed signal and the estimated first signal, the estimator 722 obtains an estimated second signal that is an estimated value of the second signal. Assuming that the mixed signal is the sum of the first and second signals and the first and second signals are uncorrelated, the power of the mixed signal is the sum of the powers of the first and second signals. Therefore, the estimator 722 obtains the power of the mixed signal and that of the estimated first signal, and subtracting the latter from the former, thereby obtaining the power of the estimated second signal. The estimator 722 obtains the estimated second signal by combining the obtained subtraction result with the phase of the mixed signal. The processing of the estimator 722 may be performed in a time domain or in a frequency domain after converting the signals into the frequency domain using Fourier transform or the like. If the processing is executed in the frequency domain, the power and the phase are combined and then converted into a time domain signal.

Figure 8A:
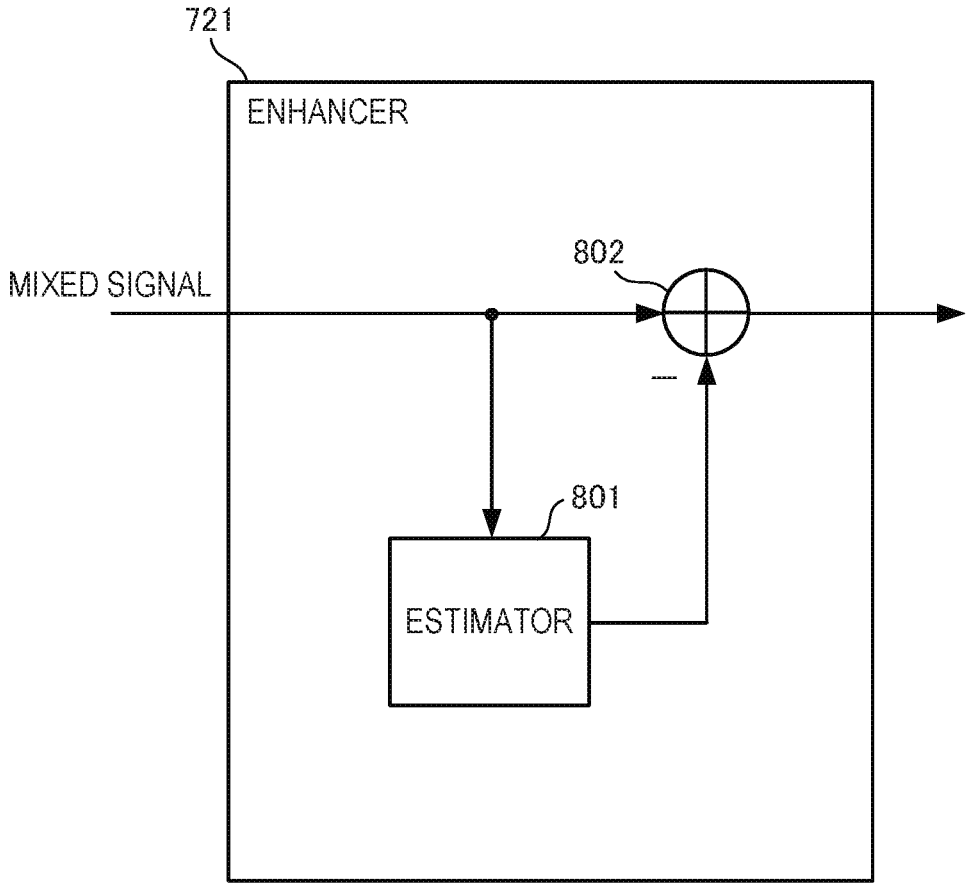
FIG. 8A is a block diagram showing the first arrangement example of an enhancer according to the seventh example embodiment of the present invention.
Figure 8B:
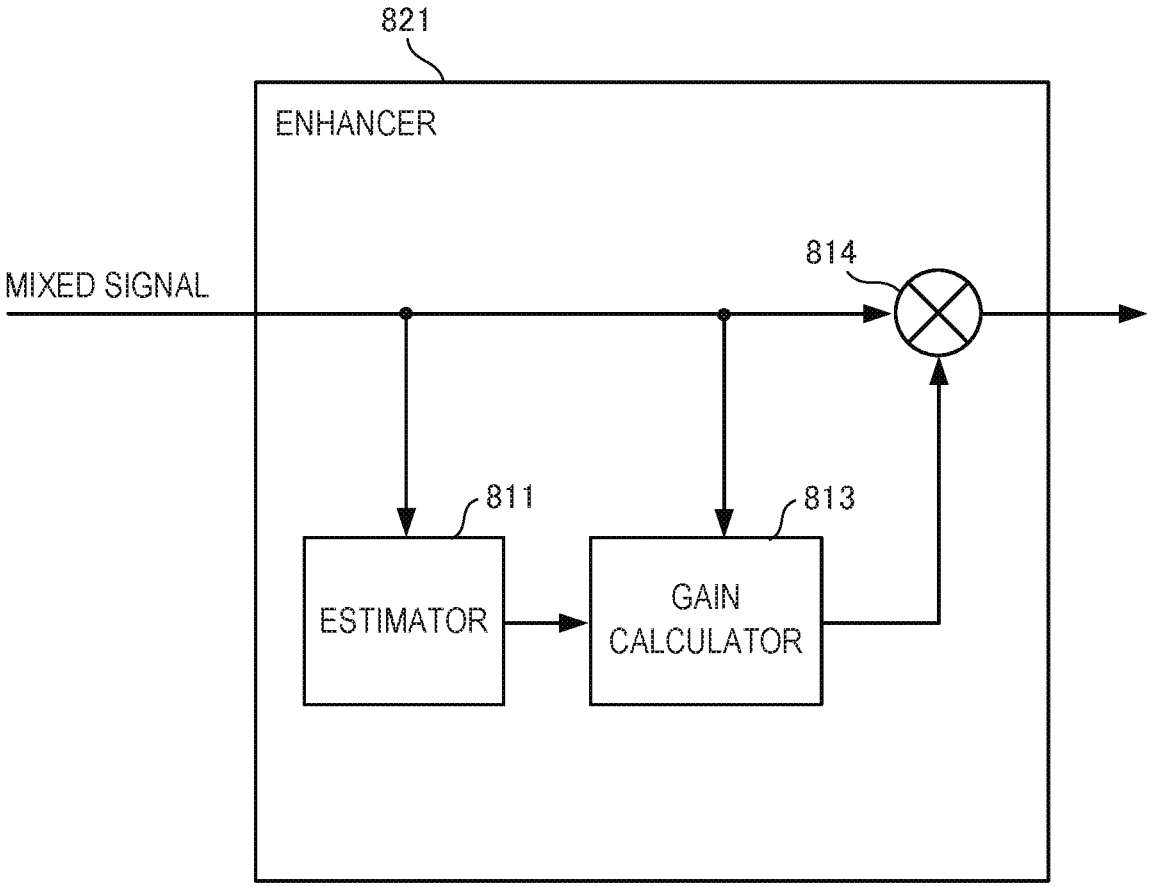
FIG. 8B is a block diagram showing the second arrangement example of the enhancer according to the seventh example embodiment of the present invention.

FIG. 8A is a block diagram showing the first arrangement example of the enhancer 721. FIG. 8B is a block diagram showing the second arrangement example of the enhancer 821. As shown in FIG. 8A, the first arrangement example of the enhancer 721 includes an estimator 801 and a subtracter 802. The estimator 801 receives a mixed signal, estimates the power of the second signal included in the mixed signal, and supplies it as an estimated value of the second signal to the subtracter 802. Many methods of estimating noise are disclosed in non-patent literature 3 and a description thereof will be omitted.

The subtracter 802 obtains the power of the supplied mixed signal, and subtracts the power of the second signal from the obtained power, thereby obtaining a subtraction signal. The subtracter 802 outputs, as an estimated first signal, a result of combining the power of the subtraction signal and the phase of the mixed signal. That is, since the subtracter 802 obtains the estimated first signal, the subtracter 802 can be regarded as an estimator. The processes in the estimator 801 and the subtracter 802 may be performed for absolute values instead of the powers. The processing of the enhancer 721 may be performed in the time domain or in the frequency domain after converting the signals into the frequency domain using Fourier transform or the like. If the processing is executed in the frequency domain, the power and the phase are combined and then converted into a time domain signal.

As shown in FIG. 8B, the second arrangement example of the enhancer 821 includes an estimator 811, a gain calculator 813, and a multiplier 814. The estimator 811 receives a mixed signal, estimates the power of the second signal, and supplies it to the gain calculator 813. The gain calculator 813 obtains the power of the supplied mixed signal, calculates the fourth gain using the power of the mixed signal and that of the second signal, and transmits it to the multiplier 814. The multiplier 814 multiplies the mixed signal by the fourth gain, and outputs the product as an estimated first signal. That is, since the multiplier 814 obtains the estimated first signal, the multiplier 814 can be regarded as an estimator. The processes in the estimator 811, the gain calculator 813, and the multiplier 814 may be performed for absolute values instead of the powers. The processing of the enhancer 821 may be performed in the time domain or in the frequency domain after converting the signals into the frequency domain using Fourier transform or the like. If the processing is executed in the frequency domain, the power and the phase are combined and then converted into a time domain signal.

With this arrangement, in addition to the effect of the first example embodiment, the separator can be implemented by a simple arrangement and it is thus possible to provide a low-end, high-performance gain adjustment apparatus.

Eighth Example Embodiment

A gain adjustment apparatus according to the eighth example embodiment of the present invention will be described with reference to FIG. 9. The gain adjustment apparatus according to this example embodiment has an arrangement obtained by replacing the separator 102 shown in FIG. 1 with a separator 902 shown in FIG. 9.

Figure 9:
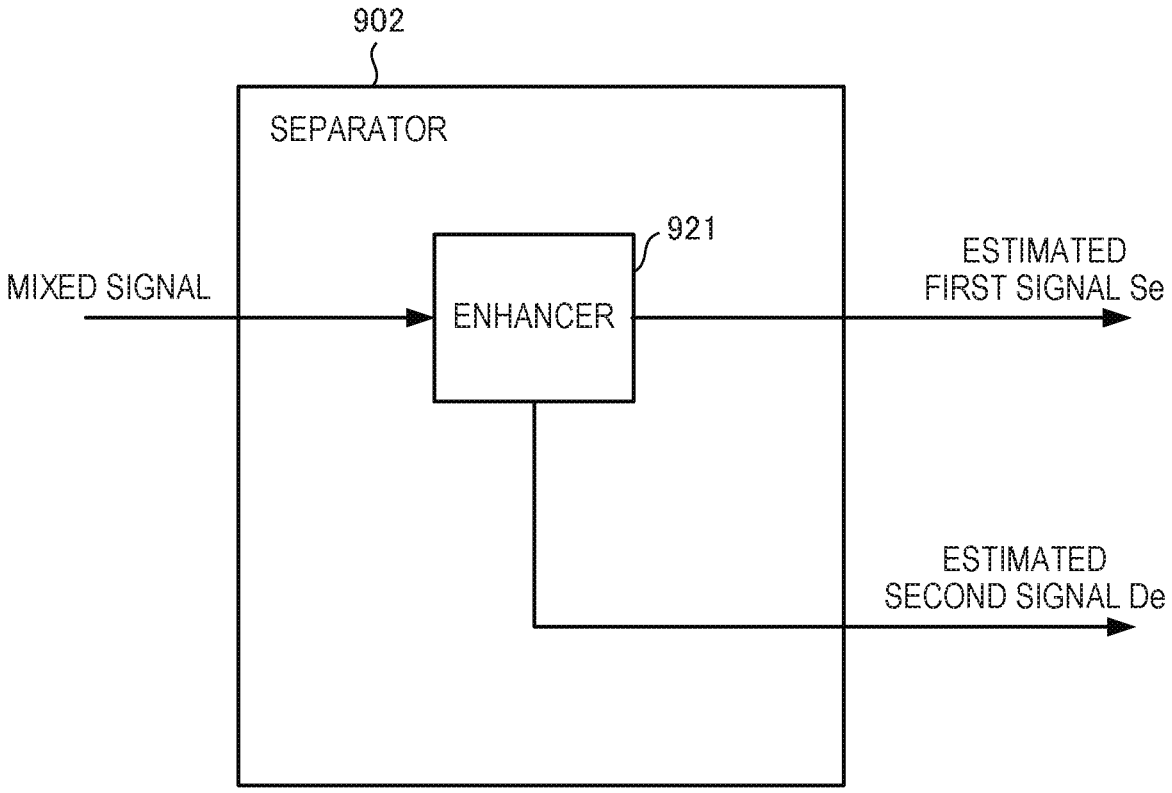
FIG. 9 is a block diagram showing the arrangement of a separator according to the eighth example embodiment of the present invention.

As shown in FIG. 9, the separator 902 includes an enhancer 921. The enhancer 921 receives a mixed signal, estimates the second signal, and outputs it as an estimated second signal that is an estimated value of the second signal. The enhancer 921 receives the mixed signal, enhances the first signal, and outputs the enhanced first signal as an estimated first signal that is an estimated value of the first signal.

Figure 10A:
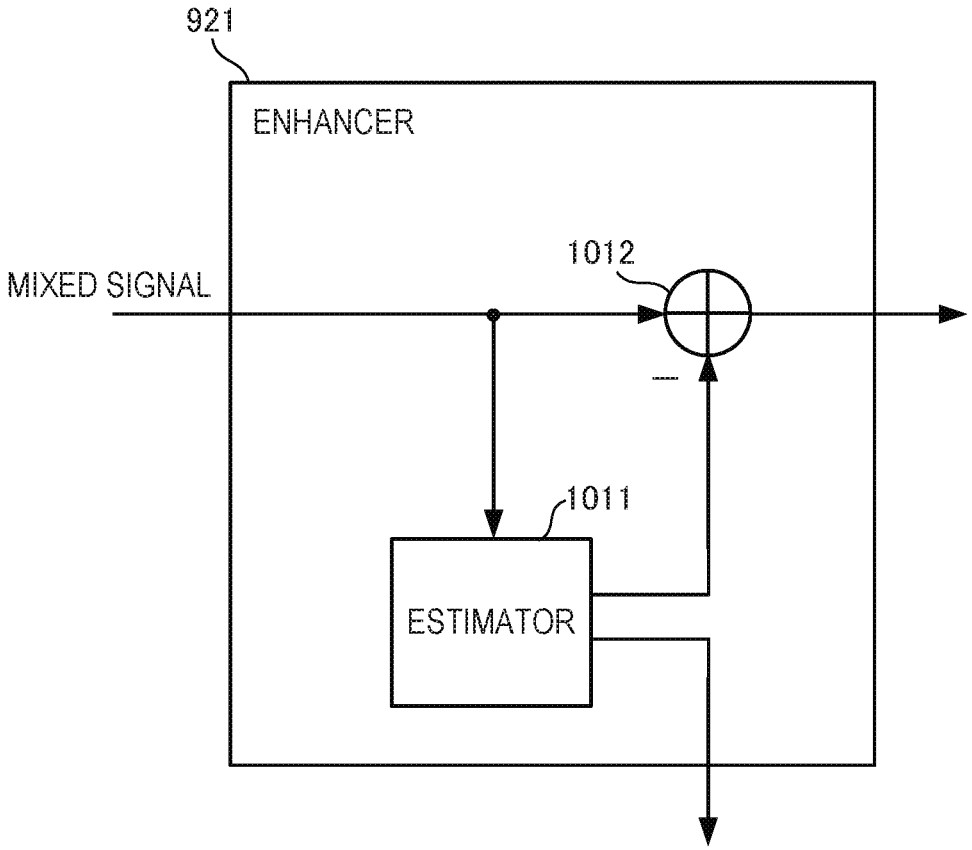
FIG. 10A is a block diagram showing the first arrangement example of an enhancer according to the eighth example embodiment of the present invention.
Figure 10B:
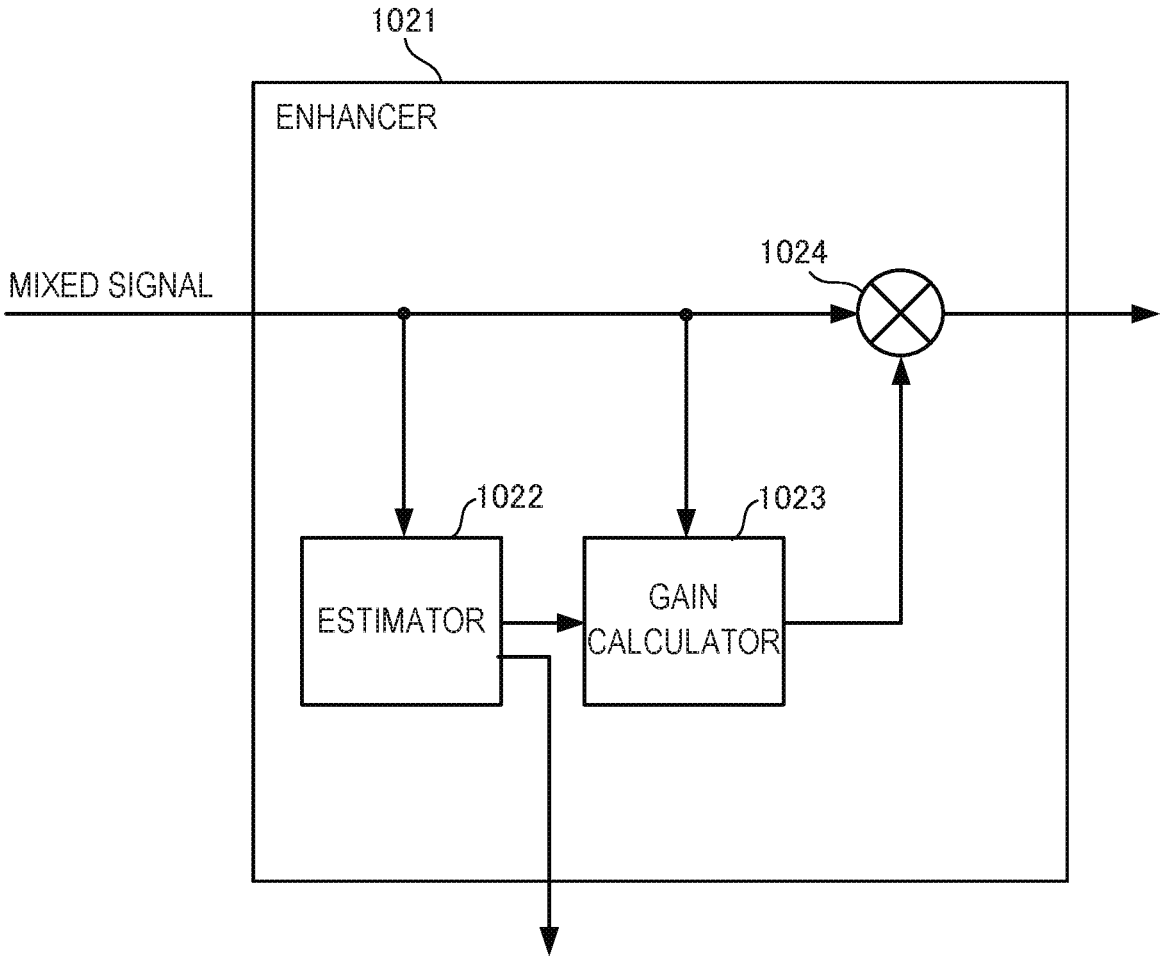
FIG. 10B is a block diagram showing the second arrangement example of the enhancer according to the eighth example embodiment of the present invention.

FIG. 10A is a block diagram showing the first arrangement example of the enhancer 921. FIG. 10B is a block diagram showing a second arrangement example of the enhancer 1021. Referring to FIG. 10A, the enhancer 921 includes an estimator 1011 and a subtracter 1012. The enhancer 921 is different from the enhancer 721 shown in FIG. 8A in that the estimator 1011 combines the estimated value of the second signal with the phase of the mixed signal and outputs the estimated second signal.

Referring to FIG. 10B, the enhancer 1021 includes an estimator 1022, a gain calculator 1023, and a multiplier 1024. The enhancer 1021 is different from the enhancer 821 shown in FIG. 8B in that the estimator 1022 combines the estimated value of the second signal with the phase of the mixed signal, and outputs the thus obtained signal as the estimated second signal that is the estimated value of the second signal.

With this arrangement, in addition to the effect of the first example embodiment, the separator can be implemented by a simpler arrangement and it is thus possible to provide a low-end, high-performance gain adjustment apparatus.

Ninth Example Embodiment

A gain adjustment apparatus according to the ninth example embodiment of the present invention will be described with reference to FIG. 11. The gain adjustment apparatus according to this example embodiment has an arrangement obtained by replacing the separator 102 shown in FIG. 1 with a separator 1102 shown in FIG. 11.

Figure 11:
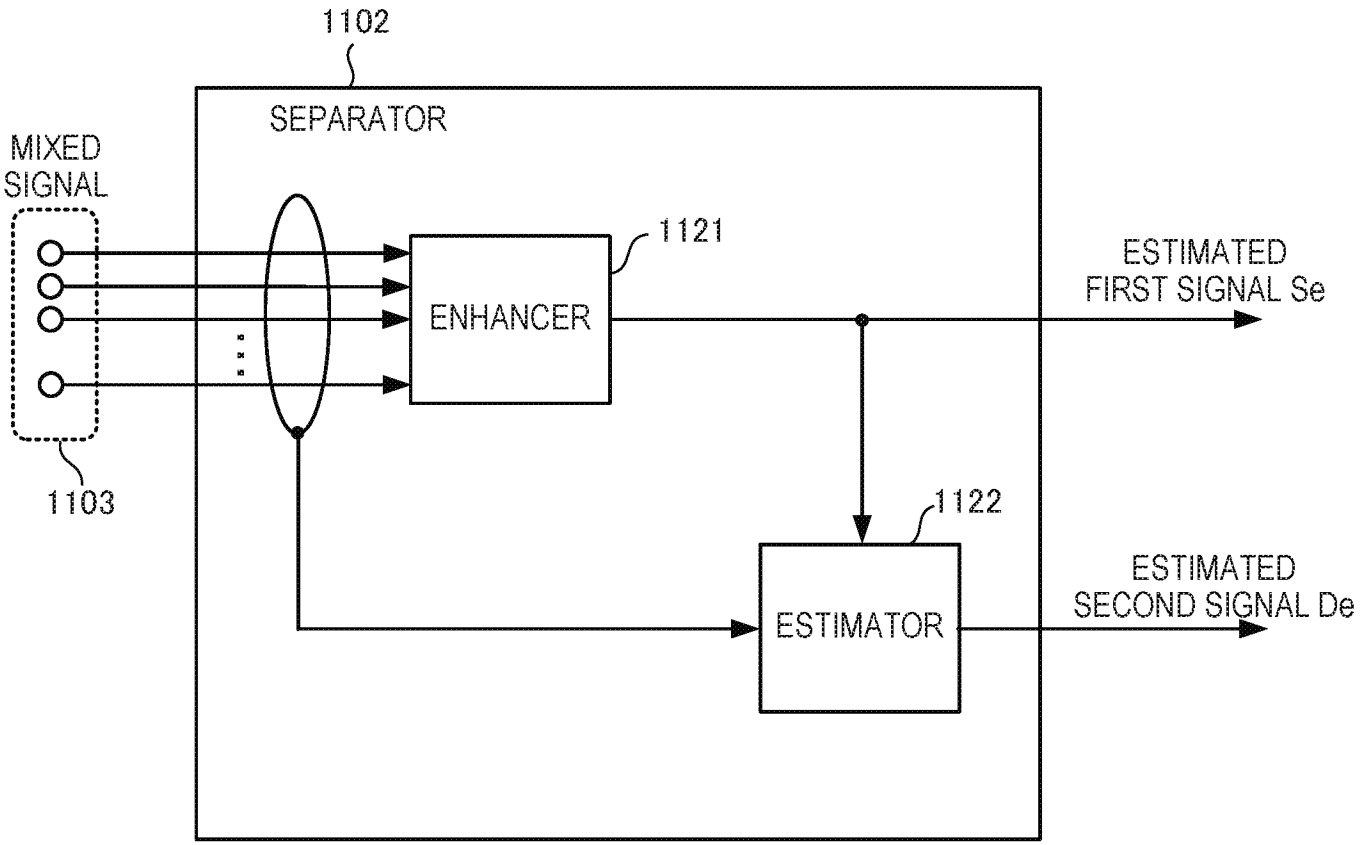
FIG. 11 is a block diagram showing an example of the arrangement of a separator according to the ninth example embodiment of the present invention.

As shown in FIG. 11, the separator 1102 includes an enhancer 1121 and an estimator 1122. The enhancer 1121 receives a plurality of mixed signals from an input terminal group 1103 formed from a plurality of input terminals, enhances the first signal based on directivity, and outputs the enhanced first signal as an estimated first signal that is an estimated value of the first signal. The plurality of mixed signals are acquired by a plurality of sensors arranged on a straight line at equal intervals, and have different phases and amplitudes in accordance with the positional relationship among the sensors. Note that if the sensors are arranged in a circle or an arc instead of the straight line or the sensors are arranged at different intervals, it is possible to use the acquired signals by performing additional processing of converting the circle or arc into a straight line or correcting the intervals between the sensors. The enhancer 1121 has an arrangement generally called a beamformer. Details of the beamformer are disclosed in patent literatures 4 and 5, non-patent literature 4, and the like.

The estimator 1122 receives the plurality of mixed signals and the estimated first signal, and obtains an estimated second signal that is an estimated value of the second signal. The estimator 1122 is different from the estimator 722 in that the estimator 1122 receives the plurality of mixed signals and integrates these signals into a single mixed signal.

As the single mixed signal, an arbitrary one of the plurality of mixed signals can be selected and used. Alternatively, a statistic value of these signals may be used. Examples of the statistic value are an average value, a maximum value, a minimum value, and a median. Each of the average value and the median provides a signal in a virtual sensor existing at the center of the plurality of sensors. The maximum value provides a signal in a sensor whose distance to a signal is shortest when the signal arrives from a direction other than the front direction. The minimum value provides a signal in a sensor whose distance to a signal is longest when the signal arrives from a direction other than the front direction. Furthermore, simple addition of these signals can be used. Alternatively, one of array signal processes described in non-patent literature 5 may be applied. The array signal processes include a delay-sum beamformer, filter-sum beamformer, MSNR (Maximum Signal-to-Noise Ratio) beamformer, MMSE (Minimum Mean Square Error) beamformer, LCMV (Linearly Constrained Minimum Variance) beamformer, and a nested beamformer. The present invention, however, is not limited to them. The thus calculated value is set as a single mixed signal.

The estimator 1122 receives the integrated single mixed signal and the estimated first signal, and obtains an estimated second signal that is an estimated value of the second signal by the same method as that in the estimator 722. The processing of the estimator 1122 may be performed in the frequency domain after converting the signals into the frequency domain using Fourier transform or the like. If the processing is executed in the frequency domain, the power and the phase are combined and then converted into a time domain signal.

Figure 12:
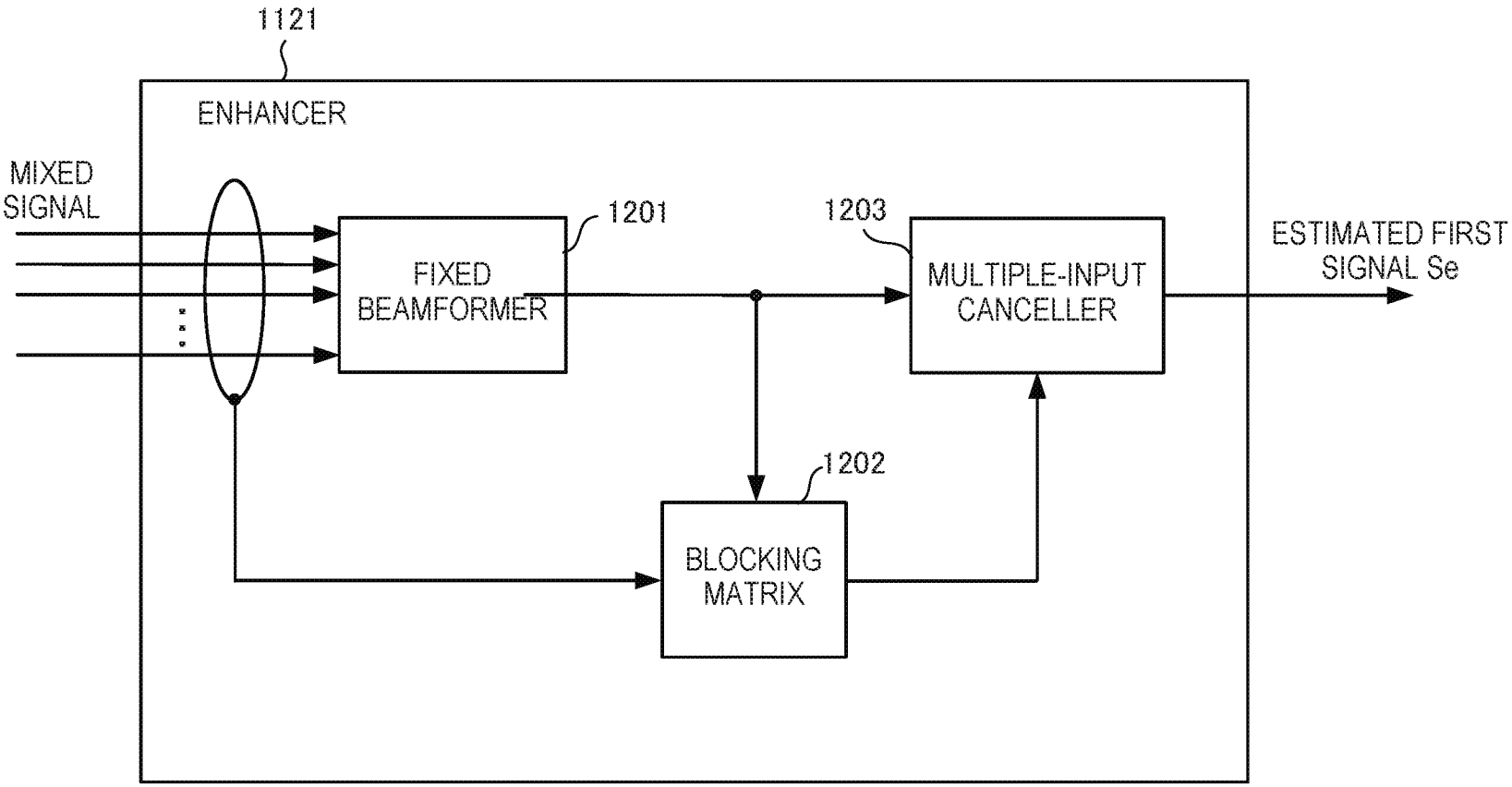
FIG. 12 is a block diagram showing the arrangement of an enhancer according to the ninth example embodiment of the present invention.

FIG. 12 is a block diagram showing an example of the arrangement of the enhancer 1121. Referring to FIG. 12, the enhancer 1121 includes a fixed beamformer 1201, a blocking matrix 1202, and a multiple-input canceller 1203.

The fixed beamformer 1201 forms a beam having high sensitivity to the direction of arrival of the first signal, and enhances the first signal, thereby obtaining an enhanced first signal. That is, the fixed beamformer 1201 functions as an enhancer for the first signal. The enhanced first signal is supplied to the blocking matrix 1202 and the multiple-input canceller 1203. As the operation of the fixed beamformer, one of the array signal processes described in non-patent literature 5 can be applied.

The blocking matrix 1202 receives the plurality of mixed signal and the enhanced first signal, and removes components correlated with the enhanced first signal from each mixed signal, thereby obtaining a plurality of pseudo second signals. That is, the blocking matrix 1202 can be regarded as an estimator for the second signal. The plurality of pseudo second signals are supplied to the multiple-input canceller 1203.

The multiple-input canceller 1203 receives the enhanced first signal and the plurality of pseudo second signals, and removes components correlated with the plurality of pseudo second signals from the enhanced first signal, thereby obtaining an estimated first signal. That is, the multiple-input canceller 1203 can be regarded as an estimator for the first signal.

As the enhancer 1121, filtering based on a phase difference described in non-patent literature 6 may be applied.

With this arrangement, in addition to the effect of the first example embodiment, the separator separates the second signal after enhancing the first signal using directivity, and it is thus possible to provide a gain adjustment apparatus having high performance, especially, with respect to a mixed signal including a signal arriving from a specific direction.

10th Example Embodiment

A gain adjustment apparatus according to the 10th example embodiment of the present invention will be described with reference to FIG. 13. The gain adjustment apparatus according to this example embodiment has an arrangement obtained by replacing the separator 102 shown in FIG. 1 with a separator 1302 shown in FIG. 13.

Figure 13:
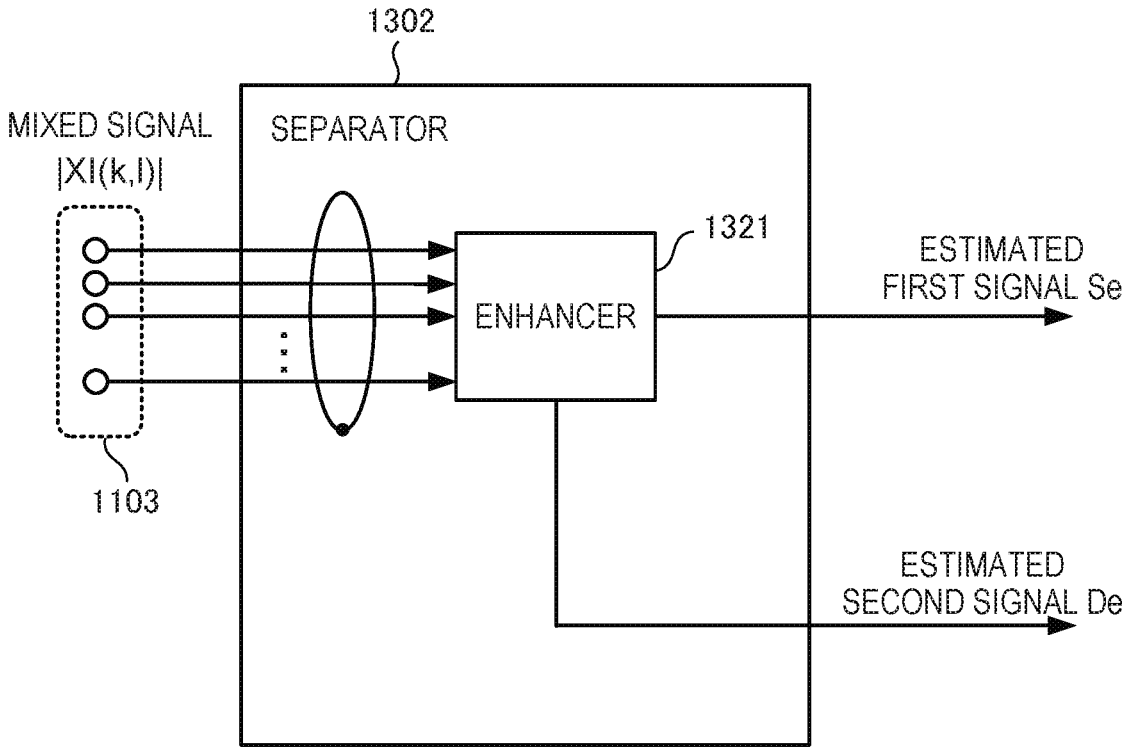
FIG. 13 is a block diagram showing the arrangement of a separator according to the 10th example embodiment of the present invention.

As shown in FIG. 13, the separator 1302 includes an enhancer 1321. The enhancer 1321 receives a plurality of mixed signals from an input terminal group 1103 formed from a plurality of input terminals, enhances the first signal based on directivity, and outputs the enhanced first signal as an estimated first signal that is an estimated value of the first signal. Furthermore, the enhancer 1321 receives the plurality of mixed signals, estimates the second signal, and outputs it as an estimated second signal that is an estimated value of the second signal.

Figure 14:
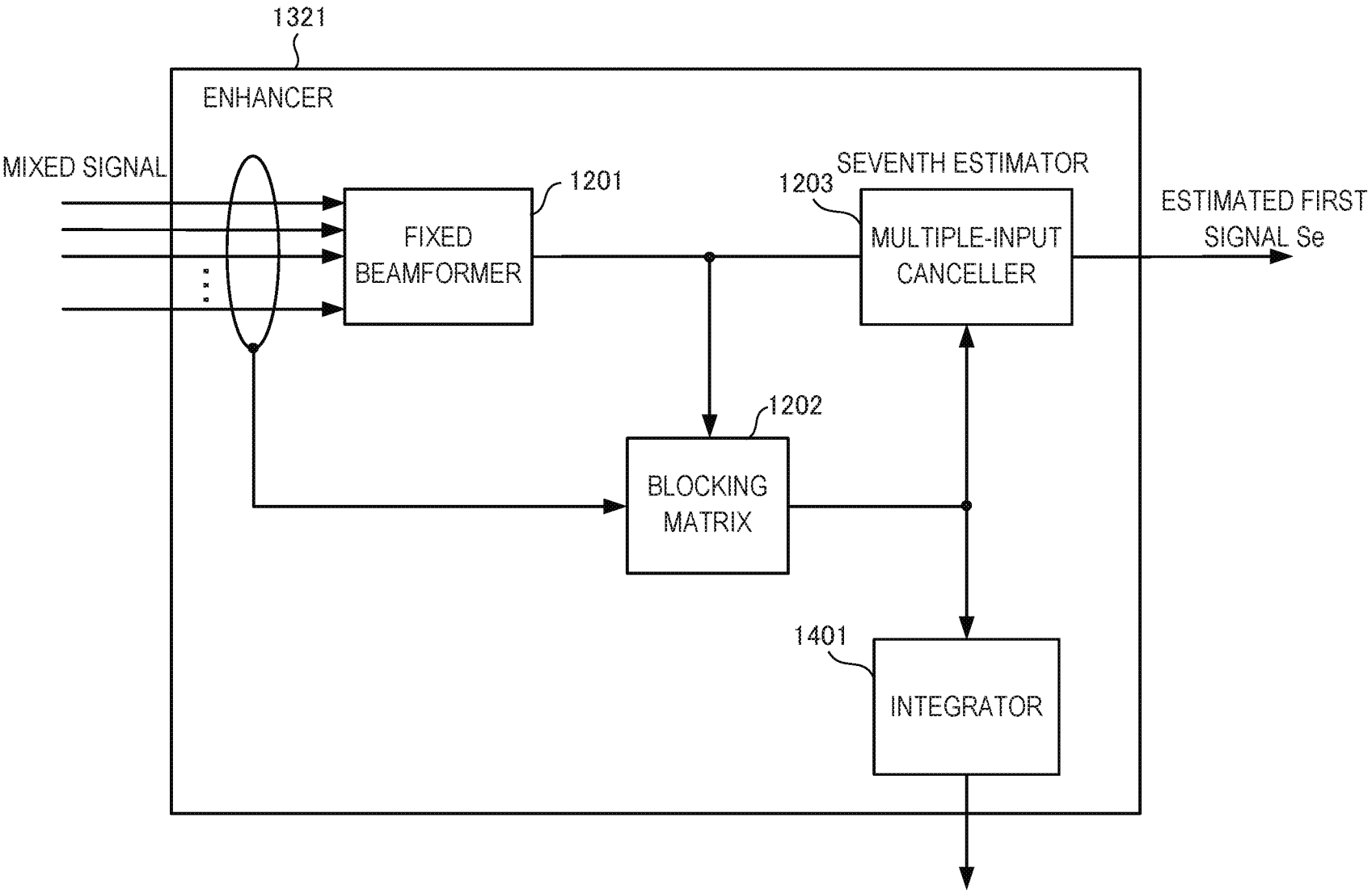
FIG. 14 is a block diagram showing the arrangement of an enhancer according to the 10th example embodiment of the present invention.

FIG. 14 is a block diagram showing an example of the arrangement of the enhancer 1321. Referring to FIG. 14, the enhancer 1321 includes an integrator 1401 in addition to the arrangement shown in FIG. 12.

The integrator 1401 integrates a plurality of pseudo second signals output from a blocking matrix 1202, and outputs the thus obtained signal as an estimated second signal that is an estimated value of the second signal.

As the estimated second signal, an arbitrary one of the plurality of pseudo second signals can be selected and used. Alternatively, a statistic value of these signals may be used. Examples of the statistic value are an average value, a maximum value, a minimum value, and a median. Each of the average value and the median provides a signal in a virtual sensor existing at the center of a plurality of sensors. The maximum value provides a signal in a sensor whose distance to a signal is shortest when the signal arrives from a direction other than the front direction. The minimum value provides a signal in a sensor whose distance to a signal is longest when the signal arrives from a direction other than the front direction. Furthermore, simple addition of these signals can be used. Alternatively, one of the array signal processes described in non-patent literature 5 may be applied. The array signal processes include a delay-sum beamformer, filter-sum beamformer, MSNR (Maximum Signal-to-Noise Ratio) beamformer, MMSE (Minimum Mean Square Error) beamformer, LCMV (Linearly Constrained Minimum Variance) beamformer, and a nested beamformer. The present invention, however, is not limited to them. The thus calculated value is set as an estimated second signal.

According to this example embodiment, with this arrangement, the separator separates the first and second signals using directivity, and it is thus possible to provide a gain adjustment apparatus having high performance and a simple arrangement, especially, with respect to a mixed signal including a signal arriving from a specific direction.

11th Example Embodiment

A gain adjustment apparatus according to the 11th example embodiment of the present invention will be described with reference to FIG. 15. The gain adjustment apparatus according to the 11th example embodiment has an arrangement obtained by replacing the separator 102 shown in FIG. 1 with a separator 1502 shown in FIG. 15.

Figure 15:
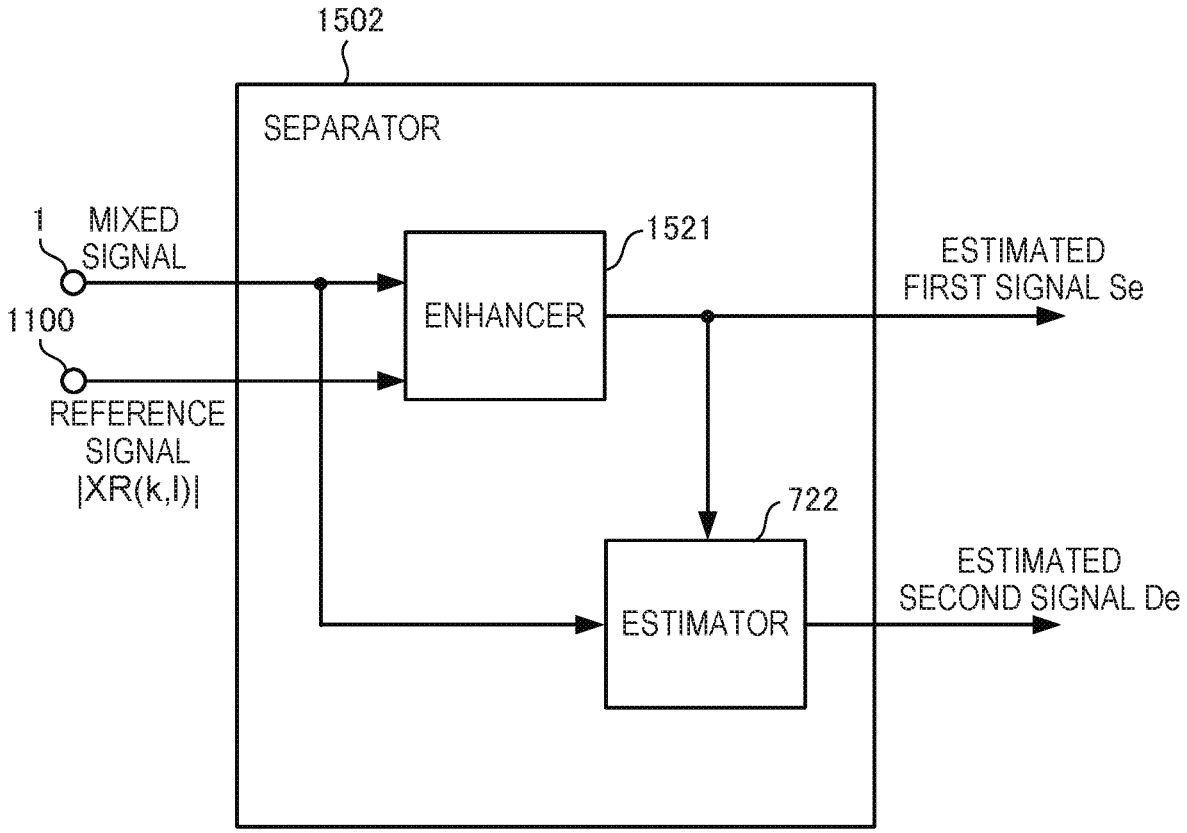
FIG. 15 is a block diagram showing the arrangement of a separator according to the 11th example embodiment of the present invention.

As shown in FIG. 15, the separator 1502 includes an enhancer 1521 and an estimator 722. The enhancer 1521 receives a mixed signal and a reference signal correlated with the second signal, enhances the first signal, and outputs the enhanced first signal as an estimated first signal that is an estimated value of the first signal. The enhancer 1521 has an arrangement generally called a noise canceller. Details of the noise canceller are disclosed in patent literatures 6 and 7, non-patent literature 7, and the like. As already described above, the estimator 722 receives the mixed signal and the estimated first signal, and obtains an estimated second signal that is an estimated value of the second signal.

Figure 16:
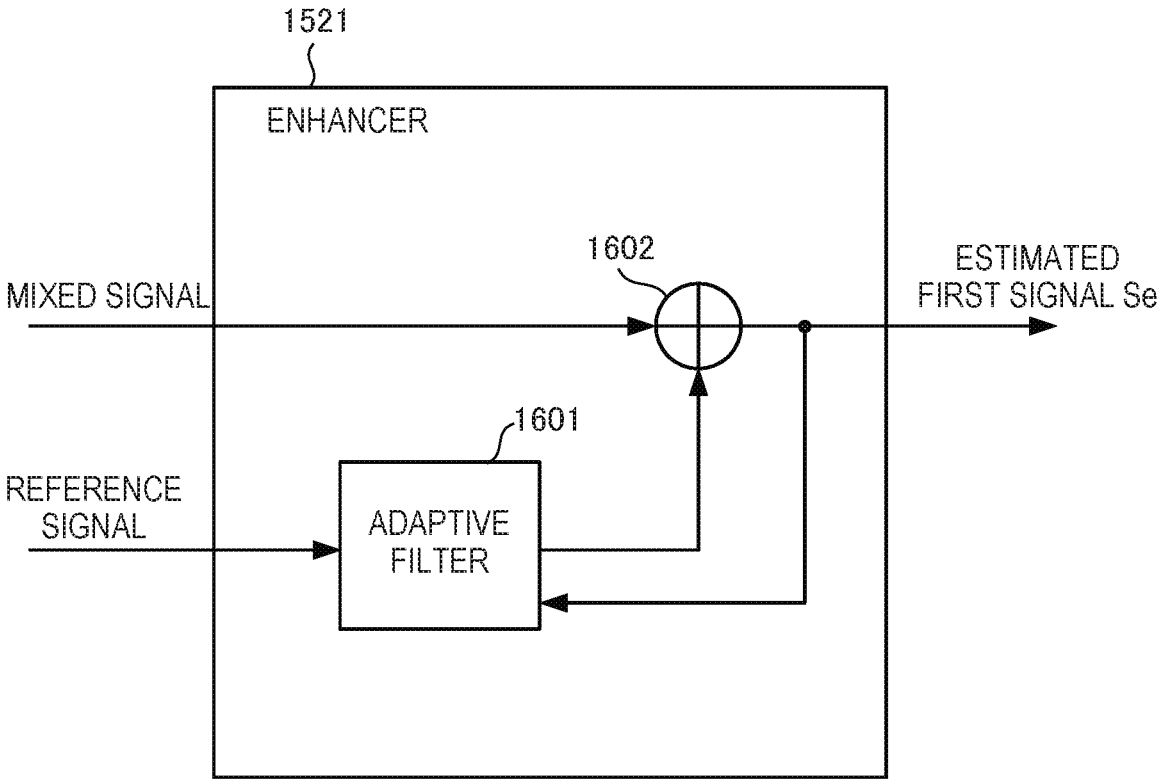
FIG. 16 is a block diagram showing the arrangement of an enhancer according to the 11th example embodiment of the present invention.

FIG. 16 is a block diagram showing an example of the arrangement of the enhancer 1521. Referring to FIG. 16, the enhancer 1521 includes an adaptive filter 1601 and a subtracter 1602. The adaptive filter 1601 receives the reference signal, performs convolution calculation with a filter coefficient, and outputs a pseudo second signal correlated with the second signal. That is, the adaptive filter 1601 functions as an estimator for the second signal. The pseudo second signal is supplied to the subtracter 1602.

The subtracter 1602 is also supplied with the mixed signal. The subtracter 1602 subtracts the pseudo second signal from the mixed signal, and outputs the subtraction result as an estimated first signal. That is, the subtracter 1602 functions as an estimator for the first signal. The filter coefficient is updated to minimize an expected value of the power of the subtraction result. As a coefficient update algorithm, the LMS (Least Mean Square) algorithm or normalized LMS algorithm is used most. These algorithms are described in patent literatures 6 and 7 and non-patent literature 7, and a detailed description thereof will be omitted. Another coefficient update algorithm such as the LS (Least Square) algorithm can also be used. The processing of the enhancer 1521 may be performed in the time domain or in the frequency domain after converting the signals into the frequency domain using Fourier transform or the like. If the processing is executed in the frequency domain, the obtained signal is converted into a time domain signal after enhancement processing.

According to this example embodiment, with this arrangement, the first signal is enhanced using the reference signal and then the second signal is separated. It is thus possible to provide a gain adjustment apparatus having high performance, especially, with respect to a mixed signal including a diffusible signal.

12th Example Embodiment

A gain adjustment apparatus according to the 12th example embodiment of the present invention will be described with reference to FIG. 17. The gain adjustment apparatus according to this example embodiment has an arrangement obtained by replacing the separator 102 shown in FIG. 1 with a separator 1702 shown in FIG. 17.

Figure 17:
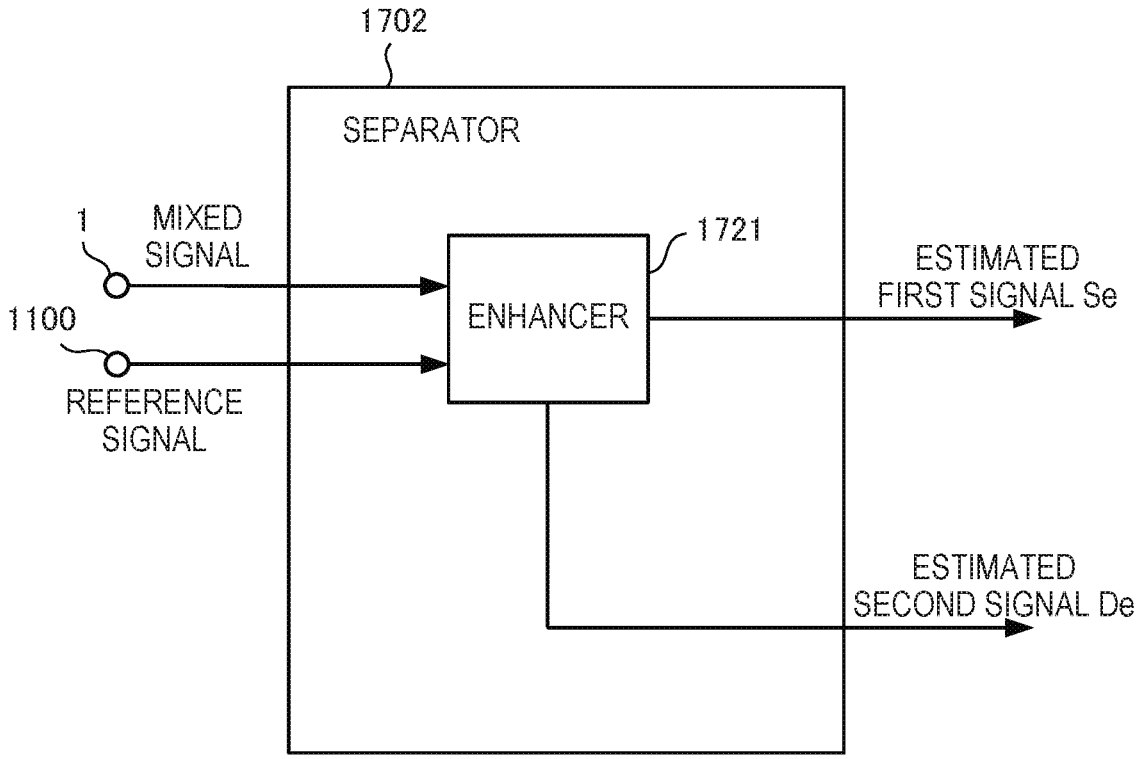
FIG. 17 is a block diagram showing the arrangement of a separator according to the 12th example embodiment of the present invention.

As shown in FIG. 17, the separator 1702 includes an enhancer 1721. The enhancer 1721 receives a mixed signal and a reference signal correlated with the second signal, enhances the first signal, and outputs the enhanced first signal as an estimated first signal that is an estimated value of the first signal. Furthermore, the enhancer 1721 obtains an estimated second signal that is an estimated value of the second signal based on the reference signal. The enhancer 1721 has an arrangement generally called a noise canceller. Details of the noise canceller are disclosed in patent literatures 6 and 7, non-patent literature 7, and the like.

Figure 18:
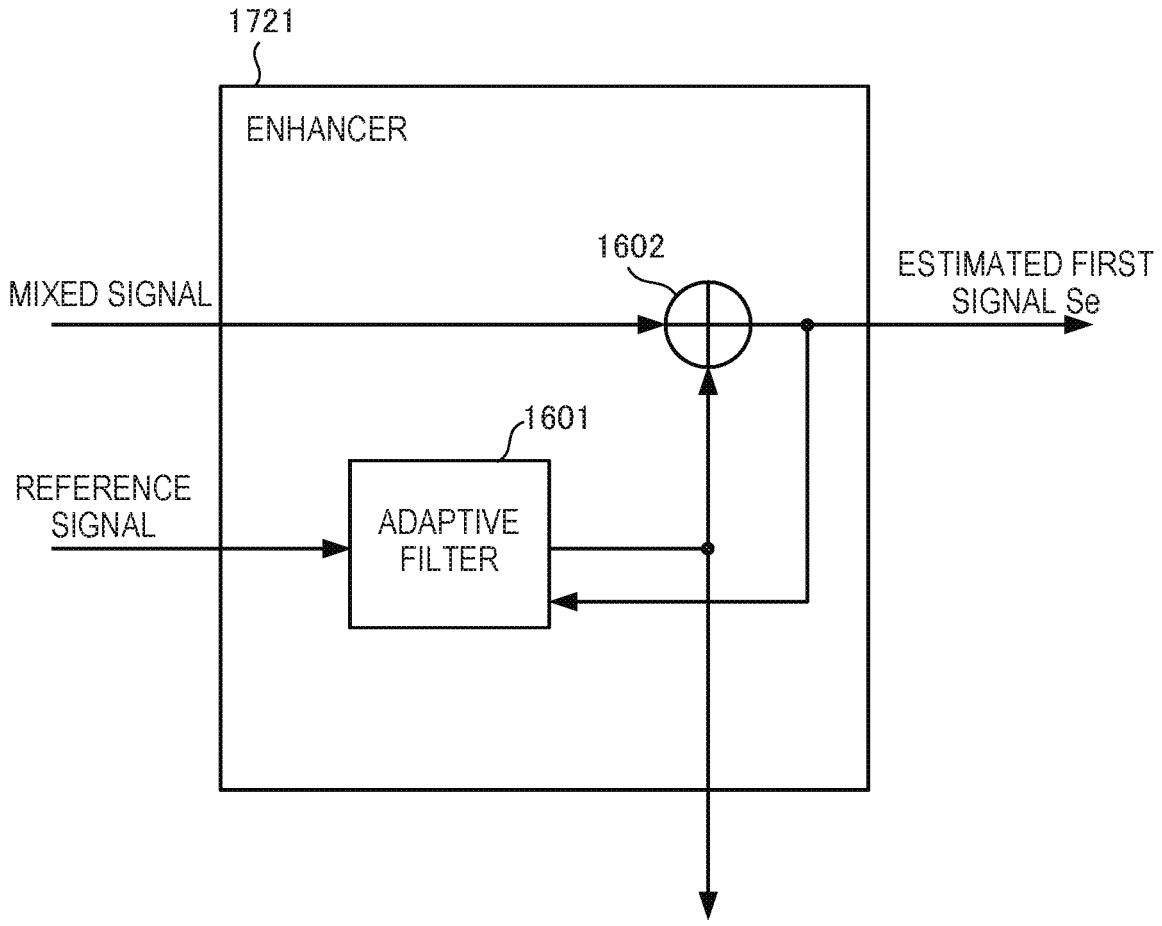
FIG. 18 is a block diagram showing the arrangement of an enhancer according to the 12th example embodiment of the present invention.

FIG. 18 is a block diagram showing an example of the arrangement of the enhancer 1721. Referring to FIG. 18, the enhancer 1721 includes an adaptive filter 1601 and a subtracter 1602.

The enhancer 1721 shown in FIG. 18 is different from the enhancer 1521 shown in FIG. 16 in that an output from the adaptive filter 1601 is output as an estimated second signal that is an estimated value of the second signal. The remaining operations are the same as in FIG. 16 and a detailed description thereof will be omitted.

With this arrangement, in addition to the effect of the first example embodiment, the first and second signals are separated using the reference signal, and it is thus possible to provide a gain adjustment apparatus having high performance, especially, with respect to a mixed signal including a diffusible signal.

13th Example Embodiment

A gain adjustment apparatus according to the 13th example embodiment of the present invention will be described with reference to FIG. 19. The gain adjustment apparatus according to this example embodiment has an arrangement obtained by replacing the gain calculator 331 shown in FIG. 3 or the gain calculator 631 shown in FIG. 6 with a gain calculator 1901 shown in FIG. 19.

The gain calculator 1901 includes an average unit 1911, a reciprocal converter 1912, a multiplier 1913, a subtracter 1914, a multiplier 1915, an adder 1916, an average unit 1917, a limiter 1918, a storage unit 1919, and a delay unit 1920. The reciprocal converter 1912 receives an estimated first signal (or provisional gain-adjusted mixed signal Sp) Se, obtains a reciprocal 1/Se (or 1/Sp), and transmits it to the multiplier 1913. The multiplier 1913 receives a step size μ and the reciprocal 1/Se (or 1/Sp) of the estimated first signal (or provisional gain-adjusted mixed signal Sp), calculates a product μ/Se (or μ/Sp) as a normalized step size, and transmits it to the multiplier 1915.

The subtracter 1914 receives a gain-adjusted mixed signal Xo and a target value St of the first signal, obtains an error Xo−St, and transmits it to the multiplier 1915. The multiplier 1915 receives the normalized step size μ/Se (or μ/Sp) and the error Xo−St, obtains a product μ(Xo−St)/Se (or μ(Xo−St)/Sp) as a gain-adjusted signal, and transmits it to the adder 1916.

Every time a first gain Gs is updated, it is stored as a new value Gsn in the storage unit 1919. The new value Gsn of the first gain Gs read out from the storage unit 1919 is transmitted to the delay unit 1920. The delay unit 1920 delays the new value Gsn of the first gain Gs, and transmits the delayed value as a current value Gsc of the first gain Gs to the adder 1916.

The adder 1916 obtains the new value Gsn of the first gain by adding the current value Gsc of the first gain Gs supplied from the delay unit 1920 and the gain-adjusted signal μ(Xo−St)/Se supplied from the multiplier 1915, and stores the obtained value in the storage unit 1919. That is, the first gain is updated by an equation below.

$$Gsn = Gsc + \mu(Xo - St)/Se$$

$$= Gsc + \mu(Xo - St)Se/Se^2$$

This equation is nothing but the normalized LMS algorithm for a one-tap adaptive filter. Therefore, to update the first gain, another adaptive filter coefficient update algorithm such as the LMS algorithm or LS algorithm can be used.

The average unit 1911 receives the estimated first signal Se, averages it, and supplies the averaged estimated first signal to the reciprocal converter 1912. The average unit 1917 receives the gain-adjusted mixed signal Xo, averages it, and supplies the averaged gain-adjusted mixed signal to the subtracter 1914. These average units reduce excessive variations in supplied signals by averaging, thereby contributing to avoidance of an undesired operation including instability caused by an excessively large or small value that occurs instantaneously.

The same applies to a case in which the gain calculator 1901 is replaced with the gain calculator 631, by replacing the estimated first signal Se with the provisional gain-adjusted mixed signal Sp.

If the first gain becomes excessively large, especially when the first signal is not sufficiently larger than the second signal, distortion occurs in the gain-adjusted mixed signal. The reason for this is as follows. That is, when the first signal is represented by S and the second signal is represented by N, a case in which the first signal is not sufficiently larger than the second signal indicates a state in which the SN ratio (SNR) is not sufficiently high. At this time, the component of the first signal is masked by the component of the second signal, and it is difficult to separate the first signal from the mixed signal. An estimated value of the first signal separated from the mixed signal in this state, that is, the estimated first signal includes a large error and is perceived as a distorted signal. This distortion poses a problem particularly when the first signal is small. When the first signal is small, the first gain takes a large value and the distortion is readily perceived by gain adjustment. To prevent this, it is effective to limit the first gain not to become excessively large when the first signal is not sufficiently larger than the second signal.

Figure 19:
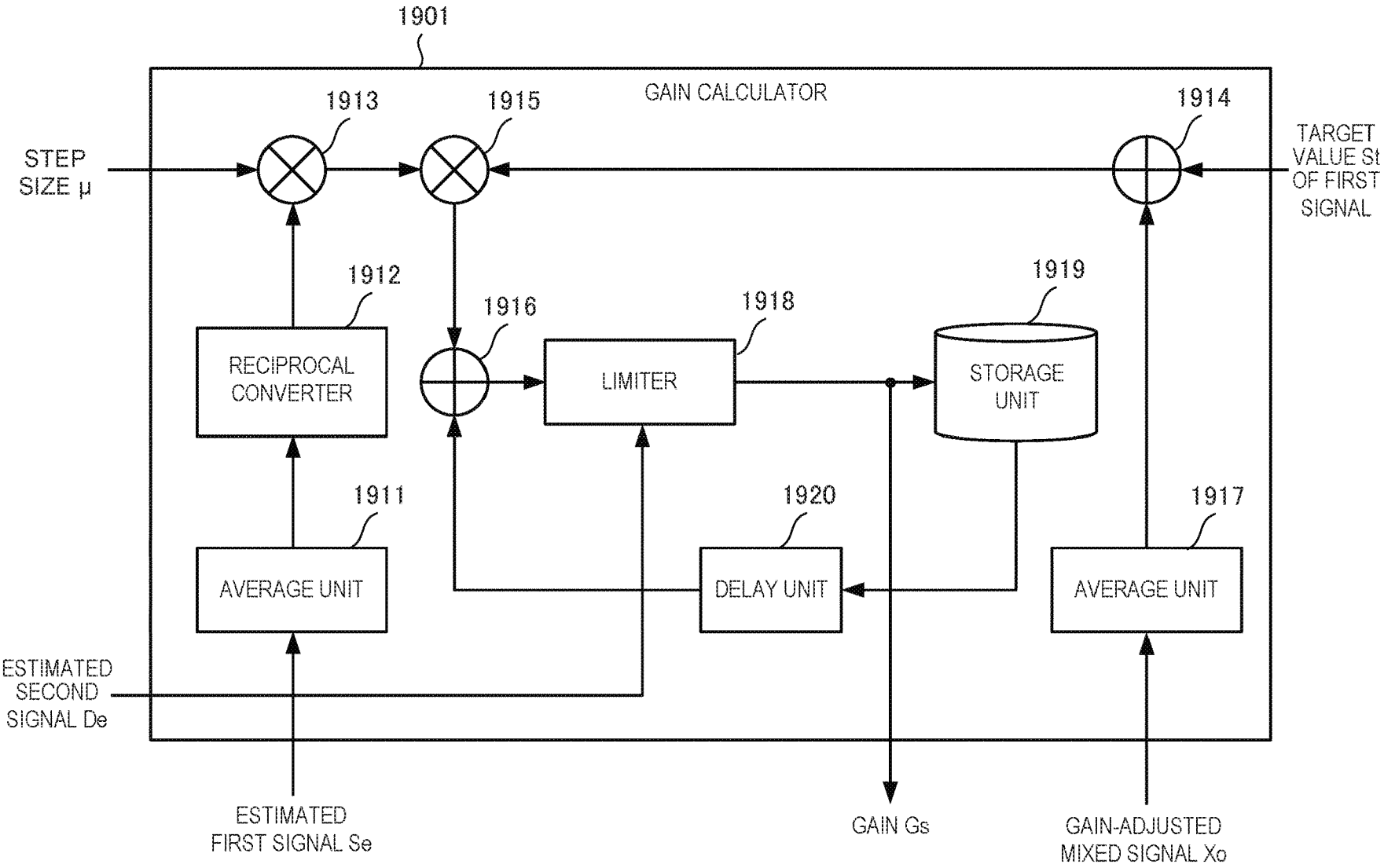
FIG. 19 is a block diagram showing the arrangement of a gain calculator according to the 13th example embodiment of the present invention.

The limiter 1918 shown in FIG. 19 prevents the distortion from being perceived by limiting the maximum value of the value of the first gain. The limiter 1918 receives the estimated second signal, limits the updated value Gsn of the first gain, and supplies the limited value to the storage unit 1919.

Figure 20:
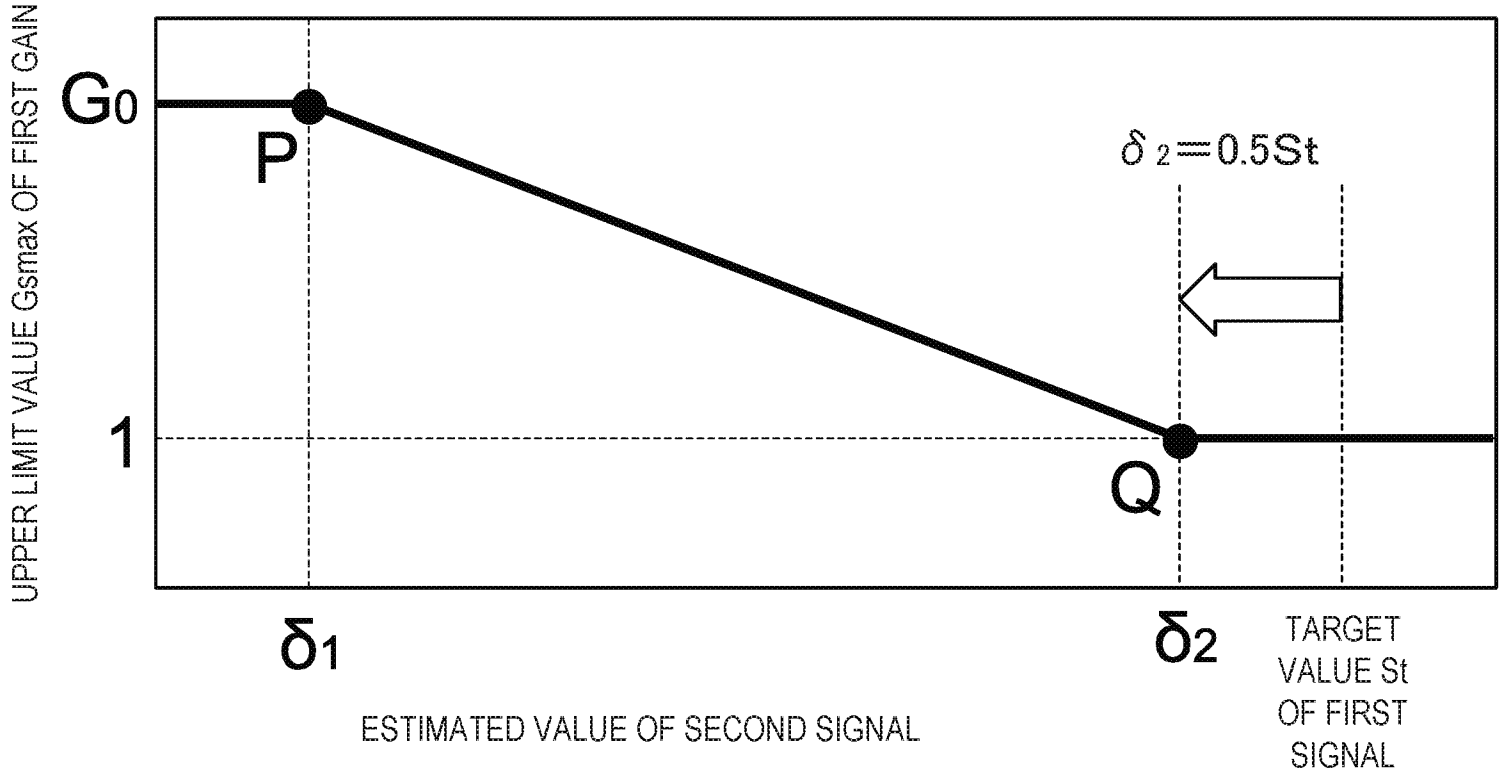
FIG. 20 is a view showing gain limiting processing in a first gain calculator according to the 13th example embodiment of the present invention.

An example of a method of determining an upper limit value Gsmax of the first gain will be described with reference to FIG. 20. In FIG. 20, the abscissa represents an estimated value of the power of the second signal, and the ordinate represents the upper limit value Gsmax of the first gain. A line segment PQ represents the first gain when the SNR of the gain-adjusted mixed signal is constant. The constant value of the SNR is determined at the position of Q. That is, Q is on a line of Gsmax=1 and the estimated value of the power of the second signal at this time is δ2.

Since Gsmax=1, the level of the first signal is equal to St, and the SNR is St/δ2. For example, if δ2 is set to be half the target value St of the first signal, that is, $\delta 2=0.5St$ is set, the SNR at Q is 3 dB. If an estimated value of the power of the second signal at P is $\delta 1$, corresponding Gsmax=G0 is given by $G0=(\delta 1/\delta 2)\cdot St=2\delta 1$ under the condition that the SNR is constant.

Although the SNRs at P and Q are equal to each other, the second signal at P is smaller than that at Q, and thus the first signal at P is smaller than that at Q, and only the LSB side of a fixed point representation is used. That is, a resolution with respect to the first signal is lower at P than at Q. If the same first gain is applied at P and Q in this state, the first gain at P becomes excessively large and distortion in the gain-adjusted mixed signal is perceived.

To avoid the distortion from being perceived, the upper limit value Gsmax=G0 is introduced to the first gain. Since the upper limit value of the first gain depends on the minimum value of the first signal, the minimum value of the first signal is estimated and the upper limit value is determined based on the estimated minimum value. The minimum value of the first signal can be obtained by, for example, sequentially comparing the value of the estimated first signal with a provisional minimum value, and setting a smaller value as a new provisional minimum value. The first value of the estimated first signal is set as the initial value of the provisional minimum value. The upper limit value of the first gain may be obtained by assigning in advance an appropriate fixed value as the minimum value of the first signal, and reading it out from a storage device.

The minimum value can be provided for the upper limit value Gsmax of the first gain. For example, referring to FIG. 20, when the level of the estimated second signal is higher than $\delta 2$, the upper limit value Gsmax of the first gain is smaller than 1. This attenuates the input mixed signal, and does not occur normally. It is possible to avoid unnatural signal attenuation by setting the minimum value of the upper limit value Gsmax of the first gain to 1. The limiter 1918 applies this minimum value.

Setting of the maximum and minimum values of the upper limit value Gsmax of the first gain has been described with reference to FIG. 20. This description is merely an example and, in fact, the maximum and minimum values may appropriately be set in accordance with an application.

According to this example embodiment, with this arrangement, in addition to the effect of the first example embodiment, when calculating a gain, the upper limit value of the gain is limited to a predetermined range, and it is thus possible to avoid unnatural signal attenuation and distortion caused by excessive amplification when the power of a desired signal is particularly small.

14th Example Embodiment

Figure 21:
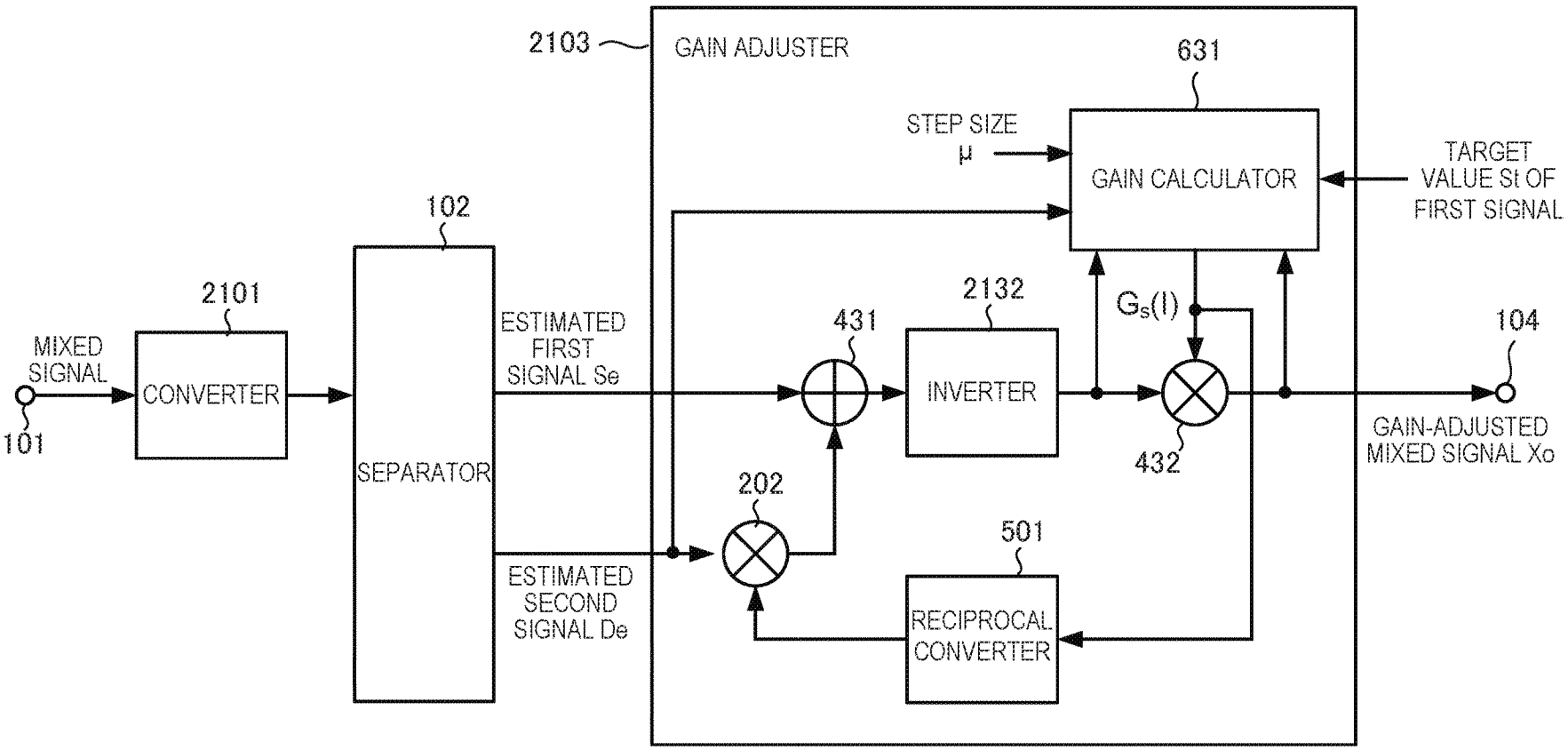
FIG. 21 is a block diagram showing the arrangement of a gain adjustment apparatus according to the 14th example embodiment of the present invention.

A gain adjustment apparatus according to the 14th example embodiment of the present invention will be described with reference to FIG. 21.

The difference from the sixth example embodiment of the present invention is that a mixed signal converted into the frequency domain by a converter 2101 is supplied to a separator 102, and a provisional gain-adjusted mixed signal output from an adder 431 is converted into the time domain by an inverter 2132 and then supplied to a multiplier 432 and a gain calculator 631. The arrangements and operations of the converter 2101 and the inverter 2132 are described in patent literature 7 and a description thereof will be omitted.

By executing separation processing in the frequency domain, it is possible to apply different processing for each frequency in accordance with the distribution states (power spectra or amplitude spectra) of the frequency components of an input mixed signal and the first and second signals as separation targets, thereby making it possible to improve the separation accuracy of the first and second signals.

Note that the inverter needs to be arranged before the gain calculator. This is because if a different gain is obtained for each frequency, the shape of the power spectrum or amplitude spectrum of a signal to be applied with the gain may be destroyed.

Furthermore, the converter 2101 and the inverter 2132 can be configured to simply perform only frame division and frame composition. Since one common gain is calculated for a plurality of signal samples forming a frame, the effect of averaging works to make it possible to obtain a stable value of a gain for a signal with high non-stationarity. Therefore, it is possible to perform gain adjustment capable of executing stable gain control.

According to this example embodiment, with this arrangement, processing is performed in the frequency domain when separating a desired signal and another signal, and it is thus possible to provide a gain adjustment apparatus that can perform stable gain control for a signal with high separation accuracy and high non-stationarity.

15th Example Embodiment

Figure 22:
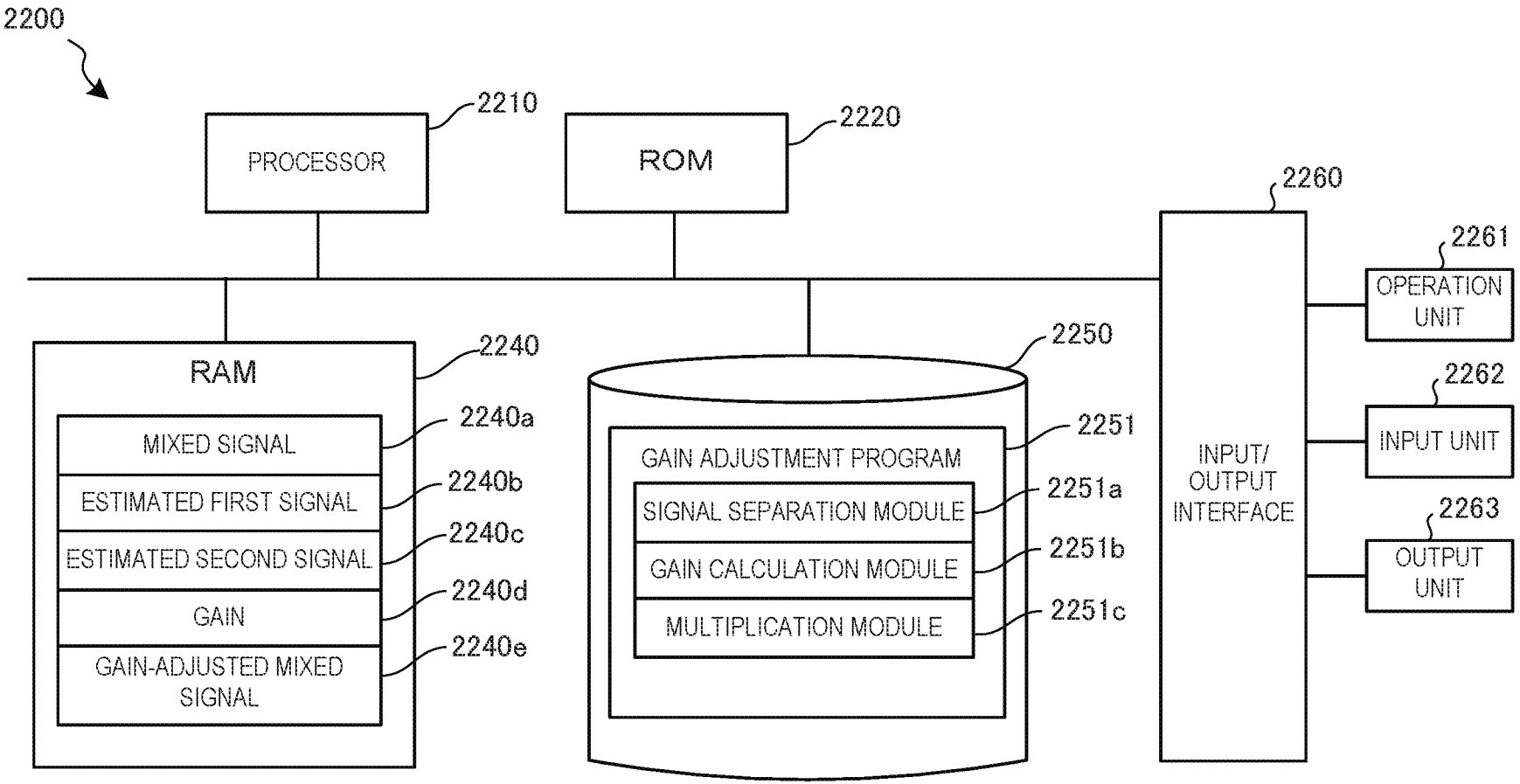
FIG. 22 is a block diagram showing the hardware arrangement of a gain adjustment apparatus according to the 15th example embodiment of the present invention.

A gain adjustment apparatus according to the 15th example embodiment of the present invention will be described with reference to FIGS. 22 and 23. FIG. 22 is a block diagram for explaining a hardware arrangement when a gain adjustment apparatus 2200 according to this example embodiment is implemented using software.

The gain adjustment apparatus 2200 includes a processor 2210, a ROM (Read Only Memory) 2220, a RAM (Random Access Memory) 2240, a storage 2250, an input/output interface 2260, an operation unit 2261, an input unit 2262, and an output unit 2263. The processor 2210 is a central processing unit, and controls the overall gain adjustment apparatus 2200 by executing various programs.

The ROM 2220 stores a boot program to be executed first by the processor 2210, various parameters, and the like. The RAM 2240 has a program load area (not shown), and an area for storing a mixed signal 2240*a* (input signal), an estimated first signal 2240*b*, an estimated second signal 2240*c*, a gain 2240*d*, a gain-adjusted mixed signal 2240*e* (output signal), and the like.

The storage 2250 also stores a gain adjustment program 2251. The gain adjustment program 2251 includes a signal separation module 2251*a*, a gain calculation module 2251*b*, and a multiplication module 2251*c*. When the processor 2210 executes the modules included in the gain adjustment program 2251, the functions of the separator 102 shown in FIG. 1 and the gain calculators 331 and 332, the multiplier 231 and 232, and the adder 233 shown in FIG. 3 can be implemented.

The gain-adjusted mixed signal 2240*e* as an output associated with the gain adjustment program 2251 executed by the processor 2210 is output from the output unit 2263 via the input/output interface 2260. This can individually perform gain adjustment for a desired signal and another signal included in the mixed signal 2240*a* input from the input unit 2262.

Figure 23:
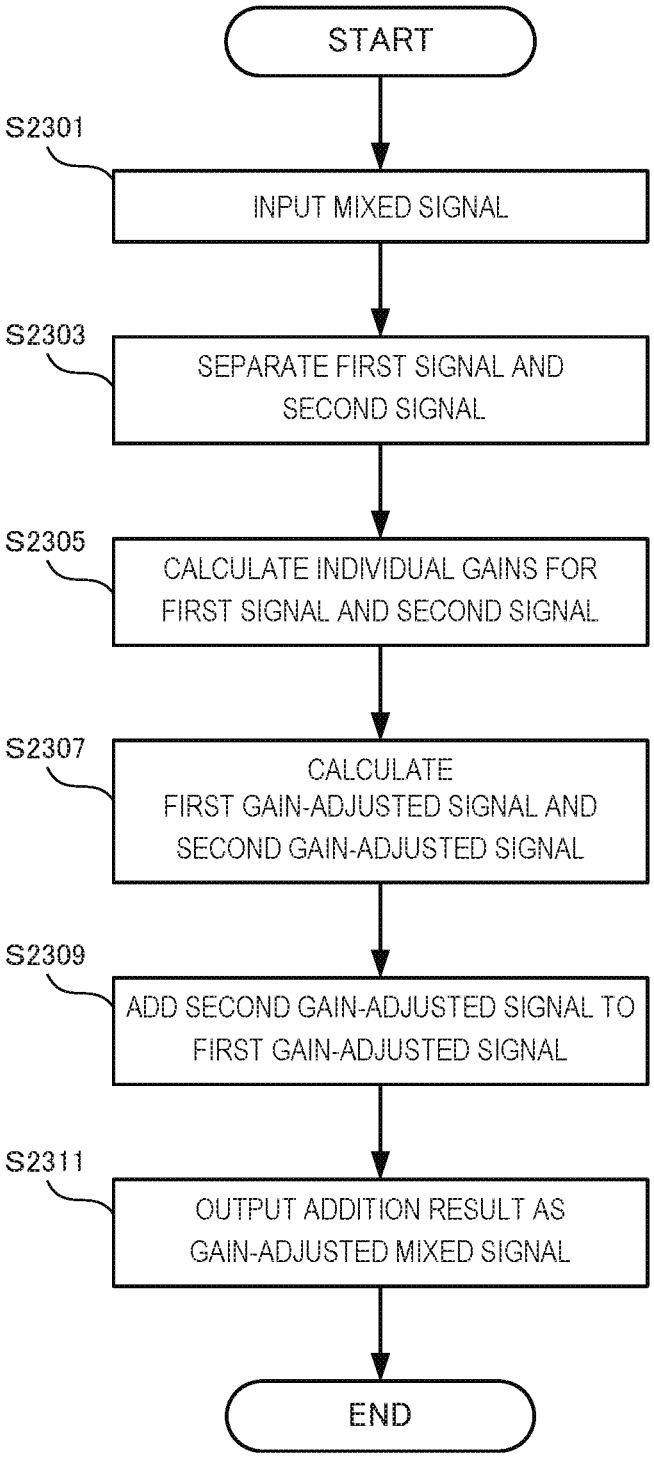
FIG. 23 is a flowchart for explaining the processing procedure of the gain adjustment apparatus according to the 15th example embodiment of the present invention.

FIG. 23 is a flowchart for explaining a processing procedure of individually performing gain adjustment for a desired signal and another signal by the gain adjustment program 2251. In step S2301, the mixed signal 2240*a* including the first and second signals is supplied to the separator 102. In step S2303, the first and second signals are separated.

In step S2305, individual gains are calculated for the first and second signals. In step S2307, a gain-adjusted first signal and a gain-adjusted second signal are calculated by applying the calculated gains, respectively. In step S2309, the gain-adjusted second signal is added to the gain-adjusted first signal to generate a gain-adjusted mixed signal.

Finally, in step S2311, the sum of the gain-adjusted first signal and the gain-adjusted second signal is output as a gain-adjusted mixed signal obtained by individually performing gain adjustment for a desired signal and another signal.

An example of the processing procedure when the gain adjuster 103 with the arrangement according to the third example embodiment is implemented by software in the gain adjustment apparatus according to this example embodiment has been explained with reference to FIG. 23. However, each of the first to 14th example embodiments can be implemented by software in the same manner by appropriately eliminating or adding differences in the respective block diagrams.

According to this example embodiment, with the above arrangement, generation of a gain-adjusted mixed signal can be implemented by software by applying different gains to the first and second signals included in a mixed signal.

Other Example Embodiments

While the invention has been particularly shown and described with reference to example embodiments thereof, the invention is not limited to these example embodiments. It will be understood by those of ordinary skill in the art that various changes in form and details may be made therein without departing from the spirit and scope of the present invention as defined by the claims.

The present invention is applicable to a system including a plurality of devices or a single apparatus. The present invention is also applicable even when an information processing program for implementing the functions of example embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described example embodiments.

Other Expressions of Example Embodiments

Some or all of the above-described example embodiments can also be described as in the following supplementary notes but are not limited to the followings.

(Supplementary Note 1)

There is provided a signal processing apparatus comprising:

a separator that obtains an estimated first signal and an estimated second signal from a mixed signal in which a first signal and a second signal are mixed; and a gain adjuster that obtains a gain-adjusted mixed signal using the estimated first signal and the estimated second signal.

(Supplementary Note 2)

There is provided the signal processing apparatus according to supplementary note 2, wherein the gain adjuster includes a first multiplier that obtains a gain-adjusted estimated first signal by applying a first gain to the estimated first signal, a second multiplier that obtains a gain-adjusted estimated second signal by applying a second gain to the estimated second signal, and a first adder that obtains a gain-adjusted mixed signal by adding the gain-adjusted estimated first signal and the gain-adjusted estimated second signal.

(Supplementary Note 3)

There is provided the signal processing apparatus according to supplementary note 1, wherein the gain adjuster includes a first gain calculator that obtains a first gain using the estimated first signal and a target value of the first signal, and a second gain calculator that obtains a second gain using the estimated second signal and a target value of the second signal.

(Supplementary Note 4)

There is provided the signal processing apparatus according to supplementary note 1, wherein the gain adjuster includes a third multiplier that obtains a gain-adjusted estimated second signal by applying a second gain to the estimated second signal, a second adder that obtains a provisional gain-adjusted mixed signal by adding the estimated first signal and the gain-adjusted estimated second signal, and a fourth multiplier that obtains a gain-adjusted mixed signal by applying a third gain to the provisional gain-adjusted mixed signal.

(Supplementary Note 5)

There is provided the signal processing apparatus according to supplementary note 4, wherein the gain adjuster further includes a first reciprocal converter that obtains a reciprocal of the third gain as the second gain.

(Supplementary Note 6)

There is provided the signal processing apparatus according to supplementary note 5, wherein the gain adjuster further includes a third gain calculator that obtains the third gain using the provisional gain-adjusted mixed signal, a target value of the first signal, and the gain-adjusted mixed signal.

(Supplementary Note 7)

There is provided the signal processing apparatus according to any one of supplementary notes 1 to 6, wherein the separator includes a first enhancer that obtains the estimated first signal by enhancing the first signal, and a first estimator that obtains the estimated second signal from the mixed signal and the estimated first signal.

(Supplementary Note 8)

There is provided the signal processing apparatus according to supplementary note 7, wherein the first enhancer includes a second estimator that obtains a pseudo second signal by estimating the second signal, and a third estimator that obtains the estimated first signal using the mixed signal and the pseudo second signal.

(Supplementary Note 9)

There is provided the signal processing apparatus according to supplementary note 7, wherein the first enhancer includes a second estimator that obtains a pseudo second signal by estimating the second signal, a fourth gain calculator that obtains a fourth gain using the mixed signal and the pseudo second signal, and a fourth estimator that obtains the estimated first signal using the mixed signal and the fourth gain.

(Supplementary Note 10)

There is provided the signal processing apparatus according to any one of supplementary notes 1 to 6, wherein the separator includes a second enhancer that obtains the estimated first signal by enhancing the first signal, and obtains the estimated second signal by estimating the second signal.

(Supplementary Note 11)

There is provided the signal processing apparatus according to supplementary note 10, wherein the second enhancer includes a second estimator that obtains a pseudo second signal by estimating the second signal, and a third estimator that obtains the estimated first signal using the mixed signal and the pseudo second signal, and outputs the pseudo second signal as the estimated second signal.

(Supplementary Note 12)

There is provided the signal processing apparatus according to supplementary note 10, wherein the second enhancer includes a second estimator that obtains a pseudo second signal by estimating the second signal, a fourth gain calculator that obtains a fourth gain using the mixed signal and the pseudo second signal, and a fourth estimator that obtains the estimated first signal using the mixed signal and the fourth gain, and outputs the pseudo second signal as the estimated second signal.

(Supplementary Note 13)

There is provided the signal processing apparatus according to any one of supplementary notes 1 to 6, wherein the separator includes a third enhancer that obtains the estimated first signal by receiving a plurality of mixed signals and enhancing the first signal, and a fifth estimator that obtains the estimated second signal from the plurality of mixed signals and the estimated first signal.

(Supplementary Note 14)

There is provided the signal processing apparatus according to supplementary note 13, wherein the third enhancer includes a fourth enhancer that obtains an enhanced first signal by receiving the plurality of mixed signals and enhancing the first signal, a sixth estimator that obtains a plurality of pseudo second signals uncorrelated with the enhanced first signal by receiving the plurality of mixed signals and the enhanced first signal, and a seventh estimator that obtains the estimated first signal using the enhanced first signal and the plurality of pseudo second signals.

(Supplementary Note 15)

There is provided the signal processing apparatus according to any one of supplementary notes 1 to 6, wherein the separator includes a fifth enhancer that obtains the estimated first signal by receiving a plurality of mixed signals and enhancing the first signal, and obtains the estimated second signal by removing correlation with the first signal from the plurality of mixed signals.

(Supplementary Note 16)

There is provided the signal processing apparatus according to supplementary note 15, wherein the fifth enhancer includes a fourth enhancer that obtains an enhanced first signal by receiving the plurality of mixed signals and enhancing the first signal, a sixth estimator that obtains a plurality of pseudo second signals uncorrelated with the enhanced first signal by receiving the plurality of mixed signals and the enhanced first signal, a seventh estimator that obtains the estimated first signal using the enhanced first signal and the plurality of pseudo second signals, and an integrator that obtains the estimated second signal by integrating the plurality of pseudo second signals.

(Supplementary Note 17)

There is provided the signal processing apparatus according to any one of supplementary notes 1 to 6, wherein the separator includes a sixth enhancer that further receives a reference signal correlated with the second signal and obtains the estimated first signal using the mixed signal and the reference signal, and a first estimator that obtains the estimated second signal from the mixed signal and the estimated first signal.

(Supplementary Note 18)

There is provided the signal processing apparatus according to supplementary note 17, wherein the sixth enhancer includes an eighth estimator that obtains a pseudo second signal correlated with the second signal using the reference signal, and a ninth estimator that obtains the estimated first signal by removing the pseudo second signal from the mixed signal.

(Supplementary Note 19)

There is provided the signal processing apparatus according to any one of supplementary notes 1 to 6, wherein the separator includes a seventh enhancer that further receives a reference signal correlated with the second signal, obtains the estimated second signal by estimating the second signal based on the reference signal, and obtains the estimated first signal by removing the estimated second signal from the mixed signal.

(Supplementary Note 20)

There is provided the signal processing apparatus according to supplementary note 19, wherein the seventh enhancer includes an eighth estimator that obtains a pseudo second signal correlated with the second signal using the reference signal, and a ninth estimator that obtains the estimated first signal by removing the pseudo second signal from the mixed signal, and outputs the pseudo second signal as the estimated second signal.

(Supplementary Note 21)

There is provided the signal processing apparatus according to any one of supplementary notes 3 to 20, wherein the first gain calculator includes a second reciprocal converter that obtains a reciprocal of the estimated first signal, a fourth multiplier that obtains a normalized signal by multiplying the reciprocal of the estimated first signal by a step size, a subtracter that obtains, as an error, a difference between the gain-adjusted mixed signal and the target value of the first signal, a fifth multiplier that obtains a gain-adjusted signal by multiplying the normalized signal by the error, a third adder that obtains an updated value of the first gain using the gain-adjusted signal and a past value of the first gain, a storage unit that stores the updated value of the first gain, and a delay unit that delays the updated value of the first gain stored in the storage unit and supplies the delayed updated value to the adder.

(Supplementary Note 22)

There is provided the signal processing apparatus according to supplementary note 21, wherein the first gain calculator further includes a limiter that receives the estimated second signal, limits the updated value of the first gain, and supplies the limited updated value to the storage unit.

(Supplementary Note 23)

There is provided the signal processing apparatus according to supplementary note 21 or 22, wherein the first gain calculator further includes a first average unit that averages the estimated first signal and supplies the averaged estimated first signal to the reciprocal unit, and a second average unit that averages the gain-adjusted mixed signal and supplies the averaged gain-adjusted mixed signal to the subtracter.

(Supplementary Note 24)

There is provided the signal processing apparatus according to any one of supplementary notes 3 to 23, wherein at least one of the estimated first signal, the estimated second signal, and the provisional gain-adjusted mixed signal is supplied as a frame signal whose unit is a frame formed from a plurality of signal samples, and one of the first gain calculator and the second gain calculator that is supplied with the frame signal calculates one gain for each frame.

(Supplementary Note 25)

There is provided a gain adjustment method comprising:

obtaining an estimated first signal and an estimated second signal by receiving a mixed signal in which a first signal and a second signal are mixed and separating the first signal and the second signal; and obtaining a gain-adjusted mixed signal by receiving the estimated first signal and the estimated second signal.

(Supplementary Note 26)

There is provided a gain adjustment method comprising:

obtaining an estimated first signal and an estimated second signal by receiving a mixed signal in which a first signal and a second signal are mixed and separating the first signal and the second signal; and obtaining a gain-adjusted mixed signal by applying different gains to the estimated first signal and the estimated second signal.

(Supplementary Note 27)

There is provided the gain adjustment method according to supplementary note 26, wherein one of the different gains is a reciprocal of the other gain.

(Supplementary Note 28)

There is provided a gain adjustment program for causing a computer to execute a method, comprising:

obtaining an estimated first signal and an estimated second signal by receiving a mixed signal in which a first signal and a second signal are mixed and separating the first signal and the second signal; and obtaining a gain-adjusted mixed signal by receiving the estimated first signal and the estimated second signal.

The invention claimed is:

1. A signal processing apparatus comprising:

a separator that receives a mixed signal in which a first signal and a second signal are mixed, estimates the second signal to obtain a pseudo second signal, obtains a gain by using the mixed signal and the pseudo second signal, and enhances the first signal by using the mixed signal and the gain to obtain an estimated first signal; and a gain adjuster that obtains a gain-adjusted mixed signal using the estimated first signal and the estimated second signal, wherein said gain adjuster includes:

a third multiplier that obtains a gain-adjusted estimated second signal by applying a second gain to the estimated second signal, a second adder that obtains a provisional gain-adjusted mixed signal by adding the estimated first signal and the gain-adjusted estimated second signal, a fourth multiplier that obtains the gain-adjusted mixed signal by applying a third gain to the provisional gain-adjusted mixed signal, and a first reciprocal converter that obtains a reciprocal of the third gain as the second gain.

2. The signal processing apparatus according to claim 1, wherein said gain adjuster includes a first multiplier that obtains a gain-adjusted estimated first signal by applying a first gain to the estimated first signal, and a first adder that obtains the gain-adjusted mixed signal by adding the gain-adjusted estimated first signal and the gain-adjusted estimated second signal.

3. The signal processing apparatus according to claim 1, wherein said gain adjuster includes a first gain calculator that obtains a first gain using the estimated first signal and a target value of the first signal, and a second gain calculator that obtains the second gain using the estimated second signal and a target value of the second signal.

4. The signal processing apparatus according to claim 3, wherein at least one of the estimated first signal, the estimated second signal, and the provisional gain-adjusted mixed signal is supplied as a frame signal whose unit is a frame formed from a plurality of signal samples, and one of said first gain calculator and said second gain calculator that is supplied with the frame signal calculates one gain for each frame.

5. The signal processing apparatus according to claim 1, wherein said gain adjuster further includes a third gain calculator that obtains the third gain using the provisional gain-adjusted mixed signal, a target value of the first signal, and the gain-adjusted mixed signal.

6. The signal processing apparatus according to claim 1, wherein said separator includes a first enhancer that obtains the estimated first signal by enhancing the first signal, and a first estimator that obtains the estimated second signal from the mixed signal and the estimated first signal.

7. The signal processing apparatus according to claim 6, wherein said first enhancer includes a second estimator that obtains the pseudo second signal by estimating the second signal, and a third estimator that obtains the estimated first signal using the mixed signal and the pseudo second signal.

8. The signal processing apparatus according to claim 6, wherein said first enhancer includes a second estimator that obtains the pseudo second signal by estimating the second signal, a fourth gain calculator that obtains a fourth gain using the mixed signal and the pseudo second signal, and a fourth estimator that obtains the estimated first signal using the mixed signal and the fourth gain.

9. The signal processing apparatus according to claim 1, wherein said separator includes a second enhancer that obtains the estimated first signal by enhancing the first signal, and obtain the estimated second signal by estimating the second signal.

10. The signal processing apparatus according to claim 9, wherein said second enhancer includes a second estimator that obtains the pseudo second signal by estimating the second signal, and a third estimator that obtains the estimated first signal using the mixed signal and the pseudo second signal, and wherein the pseudo second signal is output as the estimated second signal.

11. The signal processing apparatus according to claim 9, wherein said second enhancer includes a second estimator that obtains the pseudo second signal by estimating the second signal, a fourth gain calculator that obtains a fourth gain using the mixed signal and the pseudo second signal, and a fourth estimator that obtains the estimated first signal using the mixed signal and the fourth gain, and wherein the pseudo second signal is output as the estimated second signal.

12. A signal processing apparatus comprising:

a separator that:

receives a plurality of mixed signals in each of which a first signal and a second signal are mixed, and enhances the first signal to obtain an enhanced first signal, obtains a plurality of pseudo second signals uncorrelated with the enhanced first signal using the plurality of mixed signals and the enhanced first signal, and obtains an estimated first signal using the enhanced first signal and the plurality of pseudo second signals, and a gain adjuster that:

obtains a gain-adjusted mixed signal using the estimated first signal and the estimated second signal, obtains a gain-adjusted estimated second signal by applying a second gain to the estimated second signal, obtains a provisional gain-adjusted mixed signal by adding the estimated first signal and the gain-adjusted estimated second signal, obtains the gain-adjusted mixed signal by applying a third gain to the provisional gain-adjusted mixed signal, and obtains a reciprocal of the third gain as the second gain.

13. A signal processing apparatus comprising:

a separator that:

receives a mixed signal in which a first signal and a second signal are mixed, and enhances the first signal to obtain an enhanced first signal, obtains a plurality of pseudo second signals uncorrelated with the enhanced first signal using the enhanced first signal, obtains an estimated first signal using the enhanced first signal and the plurality of pseudo second signals, and obtains an estimated second signal by integrating the plurality of pseudo second signals and removing correlation with the first signal from the mixed signal; and a gain adjuster that:

obtains a gain-adjusted estimated second signal by applying a second gain to the estimated second signal, obtains a provisional gain-adjusted mixed signal by adding the estimated first signal and the gain-adjusted estimated second signal, obtains a gain-adjusted mixed signal by applying a third gain to the provisional gain-adjusted mixed signal, and obtains a reciprocal of the third gain as the second gain.

14. The signal processing apparatus according to claim 13, wherein said separator includes a sixth enhancer that receives a reference signal correlated with the second signal and obtains the estimated first signal using the mixed signal and the reference signal, and a first estimator that obtains the estimated second signal from the mixed signal and the estimated first signal.

15. The signal processing apparatus according to claim 14, wherein said separator obtains a pseudo second signal correlated with the second signal using the reference signal, and obtains the estimated first signal by removing the pseudo second signal from the mixed signal.

16. The signal processing apparatus according to claim 13, wherein said separator receives a reference signal correlated with the second signal, obtains the estimated second signal by estimating the second signal based on the reference signal, and obtains the estimated first signal by removing the estimated second signal from the mixed signal.

17. The signal processing apparatus according to claim 16, wherein said separator obtains a pseudo second signal correlated with the second signal using the reference signal, and obtains the estimated first signal by removing the pseudo second signal from the mixed signal, and wherein the pseudo second signal is output as the estimated second signal.

18. A signal processing apparatus comprising:

a separator that receives a mixed signal in which a first signal and a second signal are mixed, and obtains an estimated first signal and an estimated second signal; and a gain adjuster comprising:

a first gain calculator that obtains a reciprocal of the estimated first signal, obtains a normalized signal by multiplying the reciprocal of the estimated first signal by a step size, obtains, as an error, a difference between a gain-adjusted mixed signal and a target value of the first signal, obtains a gain-adjusted signal by multiplying the normalized signal by the error, and obtains an updated value of a first gain using the gain-adjusted signal and a past value of the first gain, a second gain calculator that obtains a second gain using the estimated second signal and a target value of the second signal;

a third multiplier that obtains a gain-adjusted estimated second signal by applying the second gain to the estimated second signal, a second adder that obtains a provisional gain-adjusted mixed signal by adding the estimated first signal and the gain-adjusted estimated second signal, a fourth multiplier that obtains the gain-adjusted mixed signal by applying a third gain to the provisional gain-adjusted mixed signal, and a first reciprocal converter that obtains a reciprocal of the third gain as the second gain.

19. The signal processing apparatus according to claim 18, wherein said first gain calculator further includes a limiter that receives the estimated second signal, limits the updated value of the first gain, and supplies the limited updated value to a storage unit.

20. The signal processing apparatus according to claim 18, wherein said first gain calculator further includes a first average unit that averages the estimated first signal and supplies the averaged estimated first signal to a second reciprocal converter, and a second average unit that averages a gain-adjusted remixed signal and supplies the averaged gain-adjusted mixed signal to a subtracter.

21. A gain adjustment method comprising:

receiving a mixed signal in which a first signal and a second signal are mixed;

estimating the second signal to obtain a pseudo second signal;

obtaining a gain by using the mixed signal and the pseudo second signal;

enhancing the first signal by using the mixed signal and the gain to obtain an estimated first signal;

obtaining a gain-adjusted mixed signal using the estimated first signal and the estimated second signal;

obtaining a gain-adjusted estimated second signal by applying a second gain to the estimated second signal;

obtaining a provisional gain-adjusted mixed signal by adding the estimated first signal and the gain-adjusted estimated second signal;

obtaining the gain-adjusted mixed signal by applying a third gain to the provisional gain-adjusted mixed signal; and obtaining a reciprocal of the third gain as the second gain.

22. A non-transitory computer readable medium storing a gain adjustment program for causing a computer to execute a method, comprising:

receiving a mixed signal in which a first signal and a second signal are mixed;

estimating the second signal to obtain a pseudo second signal;

obtaining a gain by using the mixed signal and the pseudo second signal;

enhancing the first signal by using the mixed signal and the gain to obtain an estimated first signal;

obtaining a gain-adjusted mixed signal using the estimated first signal and the estimated second signal;

obtaining a gain-adjusted estimated second signal by applying a second gain to the estimated second signal;

obtaining a provisional gain-adjusted mixed signal by adding the estimated first signal and the gain-adjusted estimated second signal;

obtaining the gain-adjusted mixed signal by applying a third gain to the provisional gain-adjusted mixed signal; and obtaining a reciprocal of the third gain as the second gain.

* * * * *